US009138605B2

(12) United States Patent
Pahila

(10) Patent No.: US 9,138,605 B2
(45) Date of Patent: Sep. 22, 2015

(54) FIRE PROTECTION METHOD AND SYSTEM FOR SLOPED CEILINGS

(75) Inventor: Oliver S. Pahila, Liberty, SC (US)

(73) Assignee: THE RELIABLE AUTOMATIC SPRINKLER CO., INC., Liberty, SC (US)

( * ) Notice: Subject to any disclaimer, the term of this patent is extended or adjusted under 35 U.S.C. 154(b) by 1023 days.

(21) Appl. No.: 13/129,105

(22) PCT Filed: Nov. 13, 2009

(86) PCT No.: PCT/US2009/064445

§ 371 (c)(1),
(2), (4) Date: Aug. 3, 2011

(87) PCT Pub. No.: WO2010/057029

PCT Pub. Date: May 20, 2010

(65) Prior Publication Data

US 2011/0278028 A1 Nov. 17, 2011

Related U.S. Application Data

(60) Provisional application No. 61/114,214, filed on Nov. 13, 2008.

(51) Int. Cl.

| | |
|---|---|
| ***A62C 35/11*** | (2006.01) |
| ***A62C 35/58*** | (2006.01) |
| ***A62C 35/68*** | (2006.01) |

(52) U.S. Cl.

CPC ..... *A62C 35/68* (2013.01)

(58) Field of Classification Search

CPC ..... A62C 35/11; A62C 35/13; A62C 35/58; A62C 35/60; A62C 35/62; A62C 35/64; A62C 35/68

USPC ..... 169/16, 17, 37, 43, 46, 47

See application file for complete search history.

(56) References Cited

U.S. PATENT DOCUMENTS

| | | | | |
|---|---|---|---|---|
| 5,669,449 | A * | 9/1997 | Polan et al. | 169/16 |
| 7,201,234 | B2 | 4/2007 | Rogers et al. | 169/37 |
| 8,083,002 | B1 * | 12/2011 | Golinveaux et al. | 169/46 |
| 2006/0021766 | A1 * | 2/2006 | Golinveaux | 169/46 |
| 2008/0257564 | A1 | 10/2008 | Cordell et al. | 167/17 |

* cited by examiner

*Primary Examiner* — Darren W Gorman

(74) *Attorney, Agent, or Firm* — Fitzpatrick, Cella, Harper & Scinto

(57) ABSTRACT

A method of using a residential fire protection sprinkler. The method includes providing a fluid supply conduit extending along a ceiling, having a pitch up to 12/12, at a predetermined distance relative to the ceiling and connected to a source of fluid having a predetermined source pressure. The method also includes connecting at least two residential fire protection sprinklers to the fluid supply conduit such that the sprinklers are spaced at least eight feet (8') apart from one another, wherein the sprinklers have a K-factor of at least 2.8. A residential fire protection sprinkler system is also provided. The system includes a fluid supply conduit extending along a ceiling, having a pitch of up to 12/12, at a predetermined distance relative to the ceiling and connected to a source of fluid having a predetermined source pressure. The system also includes at least two residential fire protection sprinklers connected to the fluid supply conduit such that the sprinklers are at least eight feet apart from one another, wherein the sprinklers have a K-factor of at least 2.8.

26 Claims, 26 Drawing Sheets

Fig. 7

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | High Corner ✓ | | Room Size | 20 by 24 | ft. |
| SIN | R3516 | | Coverage Area | 10 by 10 | ft. |
| Sprinkler Type | Pendent Recessed | | Nominal K-factor | 4.9 | |
| Total Flow | 26 gpm | | | | |
| Amount of Recess | 0.5 ✓ in. | | Distance from Ceiling | N/A | in. |
| Frame Arms: Perpendicularl to Backwall | | | Duration | 10.0 | min |
| Sprinkler Temperature Rating | 155 | °F | Cover Temperature | N/A | °F |
| One Sprinkler Flow | 13 | gpm | Start Time. | 9:19 AM | |
| Two Sprinkler Flow | 26 | gpm | Data File Name | A11110801 | |
| Pre-Test Crib Weight | 6.3 | Lb. | Foam Pad Weights | 1419 | grams |
| Room Ambient Temperature | 79 | °F | | 1425 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | N/A | 2:15 | | NA | 149 | |
| 2nd Sprinkler | | N/A | 2:52 | | NA | 157 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 96 | |
| TC- 2 | 5 ft., 3 in. above floor | 94 | |
| TC- 3 | 3 in below ceiling, near 1st Sprinkler | 149 | |
| TC- 4 | 2nd Sprinkler | 157 | |
| TC- 5 & 7 | Doorway Sprinklers, High & Low, Respectively | HD-122 | LD-188 |
| TC- 6 | 3 in. below ceiling, room center | 175 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 8

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | High Corner | | Room Size | 20 by 24 | ft. |
| SIN | R3516 | | Coverage Area | 10 by 10 | ft. |
| Sprinkler Type | Pendent Recessed | | Nominal K-factor | 4.9 | |
| Total Flow | 26 gpm | | | | |
| Amount of Recess | 0.5 in. | | Distance from Ceiling | N/A | in. |
| | Frame Arms: Parallel to Backwall | | Duration | 10.0 | min |
| Sprinkler Temperature Rating | 155 °F | | Cover Temperature | N/A | °F |
| One Sprinkler Flow | 13 gpm | | Start Time | 2:53 PM | |
| Two Sprinkler Flow | 26 gpm | | Data File Name | A11100801 | |
| Pre-Test Crib Weight | 6.8 Lb. | | Foam Pad Weights | 1354 | grams |
| Room Ambient Temperature | 85 °F | | | 1359 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | N/A | 2:25 | | NA | 165 | |
| 2nd Sprinkler | | N/A | 2:53 | | NA | 163 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 94 | |
| TC- 2 | 5 ft., 3 in. above floor | 84 | |
| TC- 3 | 3 in below ceiling, near 1st Sprinkler | 165 | |
| TC- 4 | 2nd Sprinkler | 163 | |
| TC- 5 & 7 | Doorway Sprinklers, High & Low, Respectively | HD-117 | LD-164 |
| TC- 6 | 3 in. below ceiling, room center | 160 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 9

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | High Corner ✓ | | Room Size | 20 by 24 | ft. |
| SIN | R3516 (CONCEALED) | | Coverage Area | 10 by 10 | ft. |
| Sprinkler Type | Pendent Concealed Blocked | | Nominal K-factor | 4.9 | |
| Total Flow | 26 gpm | | | | |
| Amount of Recess | N/A ✓ in. | | Distance from Ceiling | N/A | in. |
| Frame Axms: Perpendicularl to Backwall | | | Duration | 10.0 | min |
| Sprinkler Temperature Rating | 155 | °F | Cover Temperature | N/A | °F |
| One Sprinkler Flow | 13 | gpm | Start Time | 9:21 AM | |
| Two Sprinkler Flow | 26 | gpm | Data File Name | A11120801 | |
| Pre-Test Crib Weight | 6.7 | Lb. | Foam Pad Weights | 1370 | grams |
| Room Ambient Temperature | 76 | °F | | 1380 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:36 | 2:47 | | 174 | 186 | |
| 2nd Sprinkler | | 2:51 | 3:08 | | 149 | 166 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 96 | |
| TC- 2 | 5 ft., 3 in. above floor | 89 | |
| TC- 3 | 3 in below ceiling, near 1st Sprinkler | 186 | |
| TC- 4 | 2nd Sprinkler | 166 | |
| TC- 5 & 7 | Doorway Sprinklers, High & Low, Respectively | HD-131 | LD-189 |
| TC- 6 | 3 in. below ceiling, room center | 169 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 10

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | High Corner ✓ | Room Size | | 20 by 24 | ft. |
| SIN | R3516 (CONCEALED) | Coverage Area | | 10 by 10 | ft. |
| Sprinkler Type | Pendent Concealed Blocked | Nominal K-factor | | 4.9 | |
| Total Flow | 26 gpm | | | | |
| Amount of Recess | N/A ✓ in. | Distance from Ceiling | | N/A | in. |
| | Frame Arms: Parallel to Backwall | Duration | | 10.1 | min |
| Sprinkler Temperature Rating | 155 °F | Cover Temperature | | N/A | °F |
| One Sprinkler Flow | 13 gpm | Start Time | | 1:32 PM | |
| Two Sprinkler Flow | 26 gpm | Data File Name | | A11110803 | |
| Pre-Test Crib Weight | 6.5 Lb. | Foam Pad Weights | | 1410 | grams |
| Room Ambient Temperature | 78 °F | | | 1372 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:11 | 2:23 | | 140 | 159 | |
| 2nd Sprinkler | | 2:40 | 2:52 | | 140 | 163 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 92 | |
| TC- 2 | 5 ft., 3 in. above floor | 86 | |
| TC- 3 | 3 in below ceiling, near 1st Sprinkler | 159 | |
| TC- 4 | 2nd Sprinkler | 163 | |
| TC- 5 & 7 | Doorway Sprinklers, High & Low, Respectively | HD-139 | LD-182 |
| TC- 6 | 3 in. below ceiling, room center | 174 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 11

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | Low Corner ✓ | | Room Size | 20 by 24 | ft. |
| SIN | R3516 (CONCEALED | | Coverage Area | 10 by 10 | ft. |
| Sprinkler Type | Pendent Concealed Blocked | | Nominal K-factor | 4.9 | |
| Total Flow | 13 gpm | | | | |
| Amount of Recess | N/A ✓ in. | | Distance from Ceiling | N/A | in. |
| | Frame Arms: Parallel to Backwall | | Duration | 10.0 | min |
| Sprinkler Temperature Rating | 155 °F | | Cover Temperature | N/A | °F |
| One Sprinkler Flow | 13 gpm | | Start Time | 2:24 PM | |
| Two Sprinkler Flow | 26 gpm | | Data File Name | A11120802 | |
| Pre-Test Crib Weight | 5.9 Lb. | | Foam Pad Weights | 1390 | grams |
| Room Ambient Temperature | 76 °F | | | 1430 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:02 | 2:09 | | 86 | 91 | |
| 2nd Sprinkler | | DNO | DNO | | NA | N/A | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 111 | |
| TC- 2 | 5 ft., 3 in. above floor | 76 | |
| TC- 3 | 3 in below ceiling, near 1st Sprinkler | 114 | |
| TC- 4 | 2nd Sprinkler | 112 | |
| TC- 5 & 7 | Doorway Sprinklers, High & Low, Respectively | HD-114 | LD-135 |
| TC- 6 | 3 in. below ceiling, room center | 163 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 12

RESIDENTIAL SPRINKLER FIRE TEST (SLOPED CEILING)

| | | | | | |
|---|---|---|---|---|---|
| Tested Per Section | 5 | Subject | 1626A or 1626B | OL 1626A | |
| Test Room | Building 3A | Ceiling Slope | [8/12] or [4/12] | 8/12 | |
| Fire Location | Low Corner | Room Size | 20 by 24 | ft. | |
| SIN | R3516 (CONCEALED) | Coverage Area | 10 by 10 | ft. | |
| Sprinkler Type | Pendent Concealed Blocked | Nominal K-factor | 4.9 | | |
| Total Flow | 26 gpm | | | | |
| Amount of Recess | N/A in. | Distance from Ceiling | N/A | in. | |
| Frame Arms: Perpendicularl to Backwall | | Duration | 10.0 | min | |
| Sprinkler Temperature Rating | 155 °F | Cover Temperature | N/A | °F | |
| One Sprinkler Flow | 13 gpm | Start Time | 9:24 AM | | |
| Two Sprinkler Flow | 26 gpm | Data File Name | A11130801 | | |
| Pre-Test Crib Weight | 6.1 Lb. | Foam Pad Weights | 1400 | grams | |
| Room Ambient Temperature | 76 °F | | 1410 | grams | |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 1:56 | 2:05 | | 85 | 89 | |
| 2nd Sprinkler | | 2:10 | 2:39 | | 160 | 62 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 120 | |
| TC- 2 | 5 ft., 3 in. above floor | 80 | |
| TC- 3 | 3 in below ceiling, near 1st Sprinkler | 155 | |
| TC- 4 | 2nd Sprinkler | 177 | |
| TC- 5 & 7 | Doorway Sprinklers, High & Low, Respectively | HD-143 | LD-177 |
| TC- 6 | 3 in. below ceiling, room center | 196 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 13

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | Low Corner | | Room Size | 20 by 24 | ft. |
| SIN | RA0616 | | Coverage Area | 10 by 10 | ft. |
| Sprinkler Type | Pendent Concealed Blocked | | Nominal K-factor | 4.9 | |
| Total Flow | 28 gpm | | | | |
| Amount of Recess | N/A in. | | Distance from Ceiling | N/A | in. |
| Frame Arms: Perpendicularl to Backwall | | | Duration | 10.0 | min |
| Sprinkler Temperature Rating | 160 °F | | Cover Temperature | 135 | °F |
| One Sprinkler Flow | 14 gpm | | Start Time | 3:08 PM | |
| Two Sprinkler Flow | 28 gpm | | Data File Name | A11190805 | |
| Pre-Test Crib Weight | 5.8 Lb. | | Foam Pad Weights | 1420 | grams |
| Room Ambient Temperature | 91 °F | | | 1414 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:19 | 3:03 | | 190 | 249 | |
| 2nd Sprinkler | | 2:41 | 3:13 | | 123 | 160 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 175 | |
| TC- 2 | 5 ft., 3 in. above floor | 105 | |
| TC- 3 | 3 in below ceiling, near 1st Sprinkler | 266 | |
| TC- 4 | 2nd Sprinkler | 190 | |
| TC- 5 & 7 | Doorway Sprinklers, High & Low, Respectively | HD-183 | LD-267 |
| TC- 6 | 3 in. below ceiling, room center | 228 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at 00:00 | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 14

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | Low Corner | | Room Size | 20 by 24 | ft. |
| SIN | RA0616 | | Coverage Area | 10 by 10 | ft. |
| Sprinkler Type | Pendent Concealed Blocked | | Nominal K-factor | 4.9 | |
| Total Flow | 14 gpm | | | | |
| Amount of Recess | N/A in. | | Distance from Ceiling | N/A | in. |
| | Frame Arms: Parallel to Backwall | | Duration | 11.1 | min |
| Sprinkler Temperature Rating | 155 °F | | Cover Temperature | N/A | °F |
| One Sprinkler Flow | 14 gpm | | Start Time | 1:36 PM | |
| Two Sprinkler Flow | 28 gpm | | Data File Name | A11190804 | |
| Pre-Test Crib Weight | 5.8 Lb. | | Foam Pad Weights | 1414 | grams |
| Room Ambient Temperature | 83 °F | | | 1425 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:13 | 2:40 | | 102 | 115 | |
| 2nd Sprinkler | | 3:13 | DNO | | 229 | N/A | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 167 | |
| TC- 2 | 5 ft., 3 in. above floor | 97 | |
| TC- 3 | 3 in below ceiling, near 1st Sprinkler | 198 | |
| TC- 4 | 2nd Sprinkler | 257 | |
| TC- 5 & 7 | Doorway Sprinklers, High & Low, Respectively | HD-171 | LD-202 |
| TC- 6 | 3 in. below ceiling, room center | 279 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 15

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | High Corner ✓ | | Room Size | 20 by 24 | ft. |
| SIN | RA0616 | | Coverage Area | 10 by 10 | ft. |
| Sprinkler Type | Pendent Concealed Blocked | | Nominal K-factor | 4.9 | |
| Total Flow | 26 gpm | | | | |
| Amount of Recess | N/A ✓ in. | | Distance from Ceiling | N/A | in. |
| Frame Arms: Perpendicularl to Backwall | | | Duration | 10.0 | min |
| Sprinkler Temperature Rating | 155 °F | | Cover Temperature | N/A | °F |
| One Sprinkler Flow | 14 gpm | | Start Time | 9:20 AM | |
| Two Sprinkler Flow | 26 gpm | | Data File Name | A11140801 | |
| Pre-Test Crib Weight | 6.1 Lb. | | Foam Pad Weights | 1395 | grams |
| Room Ambient Temperature | 76 °F | | | 1425 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:46 | 3:19 | | 172 | 237 | |
| 2nd Sprinkler | | 2:55 | 3:19 | | 154 | 187 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 76 | |
| TC- 2 | 5 ft., 3 in. above floor | 91 | |
| TC- 3 | 3 in below ceiling, near 1st Sprinkler | 237 | |
| TC- 4 | 2nd Sprinkler | 187 | |
| TC- 5 & 7 | Doorway Sprinklers, High & Low, Respectively | HD-133 | LD-184 |
| TC- 6 | 3 in. below ceiling, room center | 166 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 16

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | High Corner | | Room Size | 20 by 24 | ft. |
| SIN | RA0616 | | Coverage Area | 10 by 10 | ft. |
| Sprinkler Type | Pendent Concealed Blocked | | Nominal K-factor | 4.9 | |
| Total Flow | 26 gpm | | | | |
| Amount of Recess | N/A in. | | Distance from Ceiling | N/A | in. |
| | Frame Arms: Parallel to Backwall | | Duration | 10.0 | min |
| Sprinkler Temperature Rating | 155 °F | | Cover Temperature | N/A | °F |
| One Sprinkler Flow | 13 gpm | | Start Time | 1:56 PM | |
| Two Sprinkler Flow | 26 gpm | | Data File Name | A11130802 | |
| Pre-Test Crib Weight | 5.9 Lb. | | Foam Pad Weights | 1365 | grams |
| Room Ambient Temperature | 76 °F | | | 1370 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:15 | 2:41 | | 167 | 209 | |
| 2nd Sprinkler | | 2:48 | 3:48 | | 163 | 198 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 82 | |
| TC- 2 | 5 ft., 3 in. above floor | 103 | |
| TC- 3 | 3 in below ceiling, near 1st Sprinkler | 209 | |
| TC- 4 | 2nd Sprinkler | 230 | |
| TC- 5 & 7 | Doorway Sprinklers, High & Low, Respectively | HD-169 | LD-209 |
| TC- 6 | 3 in. below ceiling, room center | 181 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 17

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | Low Corner | | Room Size | 20 by 24 | ft. |
| SIN | RA0612 | | Coverage Area | 10 by 10 | ft. |
| Sprinkler Type | Pendent Concealed Blocked | | Nominal K-factor | 4.3 | |
| Total Flow | 34 gpm | | | | |
| Amount of Recess | N/A in. | | Distance from Ceiling | N/A | in. |
| Frame Arms: Perpendicularl to Backwall | | | Duration | 10.0 | min |
| Sprinkler Temperature Rating | 160 | °F | Cover Temperature | 135 | °F |
| One Sprinkler Flow | 17 | gpm | Start Time | 9:32 AM | |
| Two Sprinkler Flow | 34 | gpm | Data File Name | A11200801 | |
| Pre-Test Crib Weight | 7.2 | Lb. | Foam Pad Weights | 1409 | grams |
| Room Ambient Temperature | 75 | °F | | 1420 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:02 | 2:27 | | 182 | 257 | |
| 2nd Sprinkler | | 2:19 | 2:55 | | 102 | 157 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 231 | |
| TC- 2 | 5 ft., 3 in. above floor | 100 | |
| TC- 3 | 3 in below ceiling, near 1st Sprinkler | 257 | |
| TC- 4 | 2nd Sprinkler | 190 | |
| TC- 5 & 7 | Doorway Sprinklers, High & Low, Respectively | HD-157 | LD-241 |
| TC- 6 | 3 in. below ceiling, room center | 272 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at 00:00 | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 18

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | Low Corner | | Room Size | 20 by 24 | ft. |
| SIN | RA0612 | | Coverage Area | 10 by 10 | ft. |
| Sprinkler Type | Pendent Concealed Blocked | | Nominal K-factor | 4.3 | |
| Total Flow | 18 gpm | | | | |
| Amount of Recess | N/A in. | | Distance from Ceiling | N/A | in. |
| | Frame Arms: Parallel to Backwall | | Duration | 10.0 | min |
| Sprinkler Temperature Rating | 160 | °F | Cover Temperature | 135 | °F |
| One Sprinkler Flow | 18 | gpm | Start Time | 9:17 AM | |
| Two Sprinkler Flow | 36 | gpm | Data File Name | A11210801 | |
| Pre-Test Crib Weight | 7.1 | Lb. | Foam Pad Weights | 1425 | grams |
| Room Ambient Temperature | 83 | °F | | 1395 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:08 | 2:35 | | 183 | 254 | |
| 2nd Sprinkler | | 2:19 | DNO | | 108 | N/A | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 182 | |
| TC- 2 | 5 ft., 3 in. above floor | 89 | |
| TC- 3 | 3 in below ceiling, near 1st Sprinkler | 254 | |
| TC- 4 | 2nd Sprinkler | 167 | |
| TC- 5 & 7 | Doorway Sprinklers, High & Low, Respectively | HD-129 | LD-174 |
| TC- 6 | 3 in. below ceiling, room center | 212 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at 00:00 | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 19

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | High Corner | | Room Size | 20 by 24 | ft. |
| SIN | RA0612 | | Coverage Area | 10 by 10 | ft. |
| Sprinkler Type | Pendent Concealed Blocked | | Nominal K-factor | 4.3 | |
| Total Flow | 28 gpm | | | | |
| Amount of Recess | N/A | in. | Distance from Ceiling | N/A | in. |
| Frame Arms: Perpendicularl to Backwall | | | Duration | 10.2 | min |
| Sprinkler Temperature Rating | 155 | °F | Cover Temperature | N/A | °F |
| One Sprinkler Flow | 14 | gpm | Start Time | 1:59 PM | |
| Two Sprinkler Flow | 28 | gpm | Data File Name | A11170803 | |
| Pre-Test Crib Weight | 6.7 | Lb. | Foam Pad Weights | 1355 | grams |
| Room Ambient Temperature | 80 | °F | | 1365 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 2:06 | 2:28 | | 141 | 169 | |
| 2nd Sprinkler | | 2:22 | 2:37 | | 140 | 158 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 74 | |
| TC- 2 | 5 ft., 3 in. above floor | 96 | |
| TC- 3 | 3 in below ceiling, near 1st Sprinkler | 169 | |
| TC- 4 | 2nd Sprinkler | 167 | |
| TC- 5 & 7 | Doorway Sprinklers, High & Low, Respectively | HD-164 | LD-235 |
| TC- 6 | 3 in. below ceiling, room center | 174 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

Fig. 20

RESIDENTIAL SPRINKLER FIRE TEST (SLOPED CEILING)

| | | | | | |
|---|---|---|---|---|---|
| Tested Per Section | 5 | Subject | 1626A or 1626B | UL 1626A | |
| Test Room | Building 3A | Ceiling Slope | [8/12] or [4/12] | 8/12 | |
| Fire Location | High Corner ✓ | | Room Size | 20 by 24 | ft. |
| SIN | RA0612 | | Coverage Area | 10 by 10 | ft. |
| Sprinkler Type | Pendent Concealed Blocked | | Nominal K-factor | 4.3 | |
| Total Flow | 34 gpm | | | | |
| Amount of Recess | N/A ✓ in. | | Distance from Ceiling | N/A | in. |
| | Frame Arms: Parallel to Backwall | | Duration | 10.0 | min |
| Sprinkler Temperature Rating | 155 | °F | Cover Temperature | N/A | °F |
| One Sprinkler Flow | 17 | gpm | Start Time | 7:56 AM | |
| Two Sprinkler Flow | 34 | gpm | Data File Name | A11190802 | |
| Pre-Test Crib Weight | 6.5 | Lb. | Foam Pad Weights | 1390 | grams |
| Room Ambient Temperature | 74 | °F | | 1418 | grams |

| | | Sprinkler Operation | | | | | |
|---|---|---|---|---|---|---|---|
| | | Time, min.:sec. | | | Temperature, °F | | |
| | | Cover | Sprinkler | | Cover | Sprinkler | |
| 1st Sprinkler | | 1:55 | 2:08 | | 177 | 199 | |
| 2nd Sprinkler | | 2:04 | 2:36 | | 156 | 208 | |
| 3rd- HD | 5th- HD | N/A | DNO | N/A | N/A | N/A | N/A |
| 4th- LD | 6th- LD | N/A | DNO | N/A | N/A | N/A | N/A |

| Thermocouple ID # | Location | Maximum Ceiling Temperature, °F | |
|---|---|---|---|
| TC- 1 | Above fire, in ceiling tile | 82 | |
| TC- 2 | 5 ft., 3 in. above floor | 110 | |
| TC- 3 | 3 in below ceiling, near 1st Sprinkler | 199 | |
| TC- 4 | 2nd Sprinkler | 208 | |
| TC- 5 & 7 | Doorway Sprinklers, High & Low, Respectively | HD-157 | LD-177 |
| TC- 6 | 3 in. below ceiling, room center | 168 | |

| Thermocouple Location (ID#) | Temperature Criteria | Results |
|---|---|---|
| Above fire, in ceiling tile (1) | Cannot exceed 500°F | A |
| 5 ft., 3 in. above floor (2) | Cannot exceed 200°F | A |
| 0 sec. at | Cannot exceed 130°F for 120s | A |
| 3 in below ceiling, near 1st sprinkler (#3) | Cannot exceed 600°F | A |
| 3 in. below ceiling, room center (#6) | Cannot exceed 600°F | A |

A - Acceptable B - Unacceptable HD- High Doorway LD- Low Doorway N/A- Not Applicable
DNO - Did Not Operate

FIRE PROTECTION METHOD AND SYSTEM FOR SLOPED CEILINGS

CROSS REFERENCE

This application claims the benefit of priority under 35 U.S.C. §119 of the filing date of provisional U.S. Patent Application 61/114,214, filed Nov. 13, 2008, the entire contents of which are incorporated by reference herein in their entirety.

BACKGROUND

This application relates to a fire protection method and system for the protection of residential occupancies having ceilings with a pitch up to 12/12.

Fire protection sprinklers conventionally are connected to a conduit to receive pressurized fire-extinguishing fluid, such as water. Fire protection sprinklers may be mounted on a fluid conduit running along a ceiling and may either depend downward from the conduit, which is referred to as a "pendent" configuration, or may extend upward, which is referred to as an "upright" configuration.

Residential construction often includes a variety of ceiling configurations, including curved, horizontal, beamed, and sloped ceilings such as those commonly known as "cathedral" ceilings. NFPA 13, Chapter 3, defines a "sloped ceiling" as a ceiling with a slope exceeding 2 in 12, a "flat ceiling" as a continuous ceiling in a single plane, and a "horizontal ceiling" as a ceiling with a slope not exceeding 2 in 12. (NFPA 13, 2007 Edition, 3.3.4.) Moreover, a "smooth ceiling" is defined as a continuous ceiling free from significant irregularities, lumps, or indentations. (NFPA 13, 2007 Edition, 3.3.4.) Underwriters' Laboratories® Standard 1626 covers generally fire protection standards for smooth flat horizontal ceilings for residential occupancies, and UL Standard 1626a (May 22, 2007) covers fire protection standards for sloped ceilings having a pitch not exceeding 8/12. The requirements of UL 1626a cover the fire testing of residential sprinklers for use with smooth, sloped ceilings having pitches not exceeding 8/12 for installation in accordance with the Standards for Installation of Sprinkler Systems in One- and Two-Family Dwellings and Manufactured Homes, NFPA 13D; Installation of Sprinkler Systems in Residential Occupancies up to and Including Four Stories in Height, NFPA 13R; and Installation of Sprinklers, NFPA 13.

As used in the remainder of this specification, the term "sloped ceiling" includes all ceilings having a non-zero pitch, which includes horizontal and sloped ceilings as those are defined in NFPA 13.

Rooms having sloped ceilings present specific challenges not found with rooms having smooth flat ceilings with substantially zero pitch. One difference between the two occupancies is that for two rooms having the same floor area and sharing at least one common wall height, the room with the sloped ceiling has a larger volume and an increased floor-to-sprinkler distance. These factors, taken together, tend to increase the response time for sprinklers in a room with a sloped ceiling when compared to those sprinklers used in a smooth, flat, zero-pitch ceiling sprinkler configuration. As a result of such delay in sprinkler activation, the fire has a longer period to burn and spread before activation, and so requiring a larger amount of water to control the heat release than for a flat horizontal ceiling.

A number of design factors affect the fluid flow to sprinklers installed for sloped ceilings. For example the piping sizes of the fluid supply conduit can be increased, the pressure of the fluid supply entering the sprinklers can be increased, and the orifice of the sprinkler (indirectly designated by the discharge coefficient, commonly known as the "K-factor") can be increased. The K-factor is a sprinkler's constant at a given volume flow rate and is generally calculated according to the relation: $K=Q/\sqrt{p}$, where Q is the volumetric flow rate (gpm), and p is the pressure of the fluid at the inlet of the sprinkler (psi). Modifying the fluid supply system to meet the increased fluid demand described above is costly and undesirable. It is therefore desirable to be able to provide a sloped ceiling fire protection system that does not substantially increase the cost as compared to a system that protects a similar room with a horizontal flat ceiling.

SUMMARY

In a first aspect of the invention a method of protecting a residential occupancy having a smooth flat sloped ceiling having a pitch of up to 12/12 is provided. The method includes providing at least two residential fire protection sprinklers below the smooth flat sloped ceiling of a residential occupancy having a pitch of up to 12/12, the sprinklers having a nominal K-factor of at least 2.8. The method also includes disposing the residential fire protection sprinklers at respective predetermined distances below the smooth flat sloped ceiling and spacing the sprinklers at least 8 feet apart from one another. Fluidly coupling the residential fire protection sprinklers to a fluid supply configured to supply the sprinklers with fluid at least a predetermined source pressure. Moreover, the method includes activating at least one sprinkler to deliver fluid to the residential occupancy to address a fire condition therein, and the fluid delivered per activated sprinkler is less than 0.05 gallons per minute per square foot of the listed coverage area.

In one embodiment, six fire protection sprinklers are connected to the fluid supply conduit. In such an embodiment, the sprinklers are spaced apart from one another in a grid having 10'×10' spacing. The range of K-factors that are used can include 2.8 to 14. In one embodiment, the sprinklers have a K-factor of 3.0, while in other embodiments the sprinklers can have K-factors of 4.3, 4.4, 4.9, and 5.8. The types of sprinklers include at least one of a pendent, upright, flush, recessed pendent, and concealed pendent, and horizontal sidewall. In one embodiment, such sprinklers are configured as residential fire protection sprinklers.

In another aspect of the invention a residential fire protection sprinkler system for a ceiling having a pitch of up to 12/12 is provided. The system includes a fluid supply conduit extending along the ceiling at a predetermined distance relative to the ceiling and connected to a source of fluid having a predetermined source pressure. The system also includes at least two residential fire protection sprinklers connected to the fluid supply conduit such that the sprinklers are at least eight feet apart from one another, and the sprinklers have a K-factor of at least 2.8. In one embodiment, six fire protection sprinklers are connected to the fluid supply conduit and are spaced apart from one another in a grid having 10'×10' spacing. The range of K-factors of the sprinklers that are connected to the fluid supply conduit can include K-factors of 2.8 to 14. In one embodiment, the sprinklers have a K-factor of 3.0, while in other embodiments the sprinklers have K-factors of 4.3 and 4.9. The types of sprinklers include at least one of a pendent, recessed pendent, concealed pendent, recessed concealed pendent, flat concealed pendent, and horizontal sidewall. Such sprinklers are preferably residential fire protection sprinklers. (The specific K-factors stated herein are only examples, however, and the invention encompasses the use of sprinklers whose K-factor is anywhere in the stated range.)

A fire protection method and a corresponding system are described below using such fire protection sprinklers for protecting residential occupancies having ceilings with various pitches of zero up to 12/12 (e.g., 2/12, 4/12, 10/12) which can reduce fluid flow requirements of the sprinklers conventionally used in those occupancies while meeting or exceeding all of the fire control requirements of the foregoing Underwriters' Laboratories® Standard 1626 and 1626a (May 22, 2007), and NFPA 13, 13D, and 13R.

BRIEF DESCRIPTION OF THE DRAWINGS

FIG. 7 shows fire test data in accordance with a third embodiment of a fire protection system.

FIG. 8 shows fire test data in accordance with the third embodiment of a fire protection system.

FIG. 9 shows fire test data in accordance with a fourth embodiment of a fire protection system.

FIG. 10 shows fire test data in accordance with the fourth embodiment of a fire protection system.

FIG. 11 shows fire test data in accordance with the fourth embodiment of a fire protection system.

FIG. 12 shows fire test data in accordance with the fourth embodiment of a fire protection system.

FIG. 13 shows fire test data in accordance with a fifth embodiment of a fire protection system.

FIG. 14 shows fire test data in accordance with the fifth embodiment of a fire protection system.

FIG. 15 shows fire test data in accordance with the fifth embodiment of a fire protection system.

FIG. 16 shows fire test data in accordance with the fifth embodiment of a fire protection system.

FIG. 17 shows fire test data in accordance with a sixth embodiment of a fire protection system.

FIG. 18 shows fire test data in accordance with the sixth embodiment of a fire protection system.

FIG. 19 shows fire test data in accordance with the sixth embodiment of a fire protection system.

FIG. 20 shows fire test data in accordance with the sixth embodiment of a fire protection system.

It should be noted that the representations shown in FIGS. 1-6 and 21-25 may show only one-half of a structure, the other half of which is not shown but is symmetric with the portion that is shown along the roof peak and high wall. In such a case, the discussion that follows, related to the configurations shown in FIGS. 1-25, applies equally to arrangements that include both halves of such structure.

DETAILED DESCRIPTION

Figure 1:
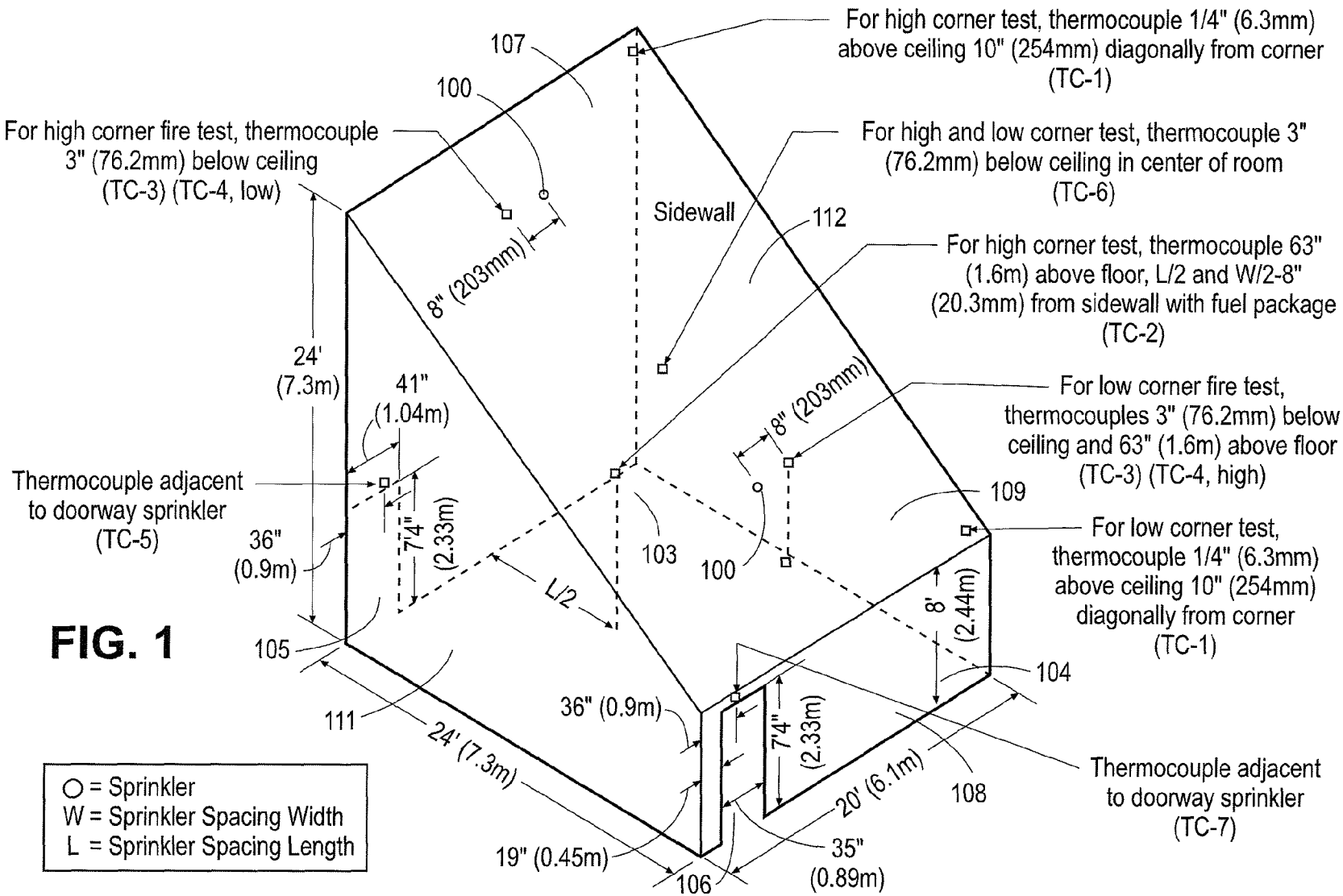
FIG. 1 is a schematic view of a testing room arranged in accordance with UL 1626a Section 5.2.4 (2007) and showing temperature measurement locations and a sprinkler arrangement.

FIG. 1 shows an example of a sprinkler configuration and testing room configuration for testing pendent, upright, flush, recessed pendent, and concealed pendent type residential fire protection sprinklers according to UL 1626a (May 22, 2007). The entire contents of UL 1626A (May 22, 2007) and of each of the other documents referred to herein, are incorporated herein by reference as if fully set forth herein. The testing room has floor dimensions of 24'×20' and has a high wall 107 with a maximum height of 24' and also has a low wall 108 opposite the high wall 107 having a height of 8'. A smooth flat ceiling 109 extends 29' from the top of the high wall 107 to the top of the low wall 108. A doorway 105 is located at one end of the high wall and another doorway 106 is located at one end of the low wall 108 across the room from the high wall 107. A sprinkler 101 is located under the header of each doorway 105, 106. The sprinklers 101 installed in the doorways 105 and 106 have the same heat responsive element and temperature rating as the other sprinklers within the room and are installed such that the center of the heat responsive element is 2 inches below the top of the doorway. A maximum of two sprinklers 100 are installed below the ceiling as specified in Section 5.2.4.4 of UL 1626a (May 2007). In particular a maximum of two sprinklers 100 are installed within 3 ft (0.9 m) vertically of the peak. Moreover, it should be noted, that in accordance with Section 1.4 of UL 1626a, the installation of the sprinklers 100 is for smooth, flat ceilings only that do not extend into or serve as a ceiling for an upper level floor in the structure in which the room may be located (not shown).

Figure 2:
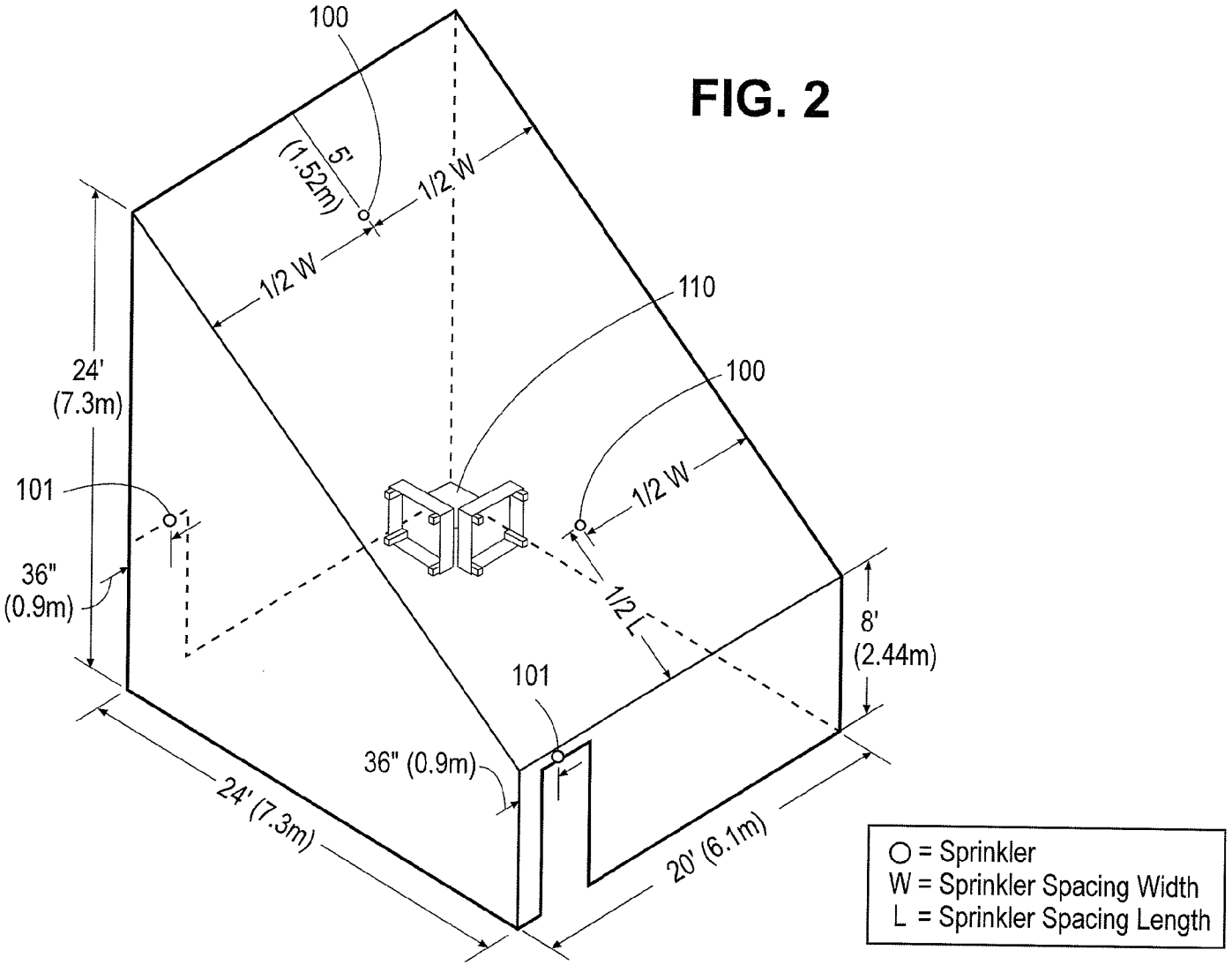
FIG. 2 is a schematic view of the testing room shown in FIG. 1, with a fuel package in a high corner.

According to UL 1626A separate testing of the sprinkler arrangement shown in FIG. 1 must be done with a consumable fuel package 110 (FIG. 2) and wood crib in the high and the low corners of the room and the room provisioned according to UL 1626A, Section 5.2.2. In FIG. 2, the consumable fuel package 110 and wood crib are disposed in a high corner 103 of the room (at the other side of the high wall 107 from the door opening 105), and in FIG. 3, the fuel package 110 and wood crib are disposed in a low corner 104 of the room (at the other side of the low wall 108 from the door opening 106). Furthermore, each pendent, upright, flush, recessed pendent, and concealed pendent sprinkler 100 must be tested in two positions during the high corner and low corner test configurations in accordance with UL 1626A (May 2007), Section 5.2.4.4. In the high corner test configuration (FIG. 2), the sprinklers 100 are tested first with the frame arms or deflector pins perpendicular to the high wall 107, and then tested in a second configuration with the frame arms or deflector pins parallel to the high wall 107. In the low corner test configuration (FIG. 3), the sprinklers 100 are tested first with the frame arms or deflector pins perpendicular to the low wall 108, and then tested in a second configuration with the frame arms or deflector pins parallel to the low wall 108. Pendent and upright sprinklers are to be installed with their deflectors located 3 inches below the ceiling or as specified in the installation instructions if other than 3 inches is specified. A pendent sprinkler intended to be installed as a recessed pendent sprinkler is tested in the most recessed position in lieu of 3 inches below the ceiling. Moreover, in accordance with UL 1626A (May 2007), Section 5.2.4.5, recessed and concealed sprinklers 100 having vented escutcheons are to be installed and tested in a manner that inhibits airflow through the escutcheons (blocked) by placing a 36 by 15½ by 8 inch (910 by 390 by 200 mm) R-25 fiberglass insulating batt over the sprinkler 100.

Figure 3:
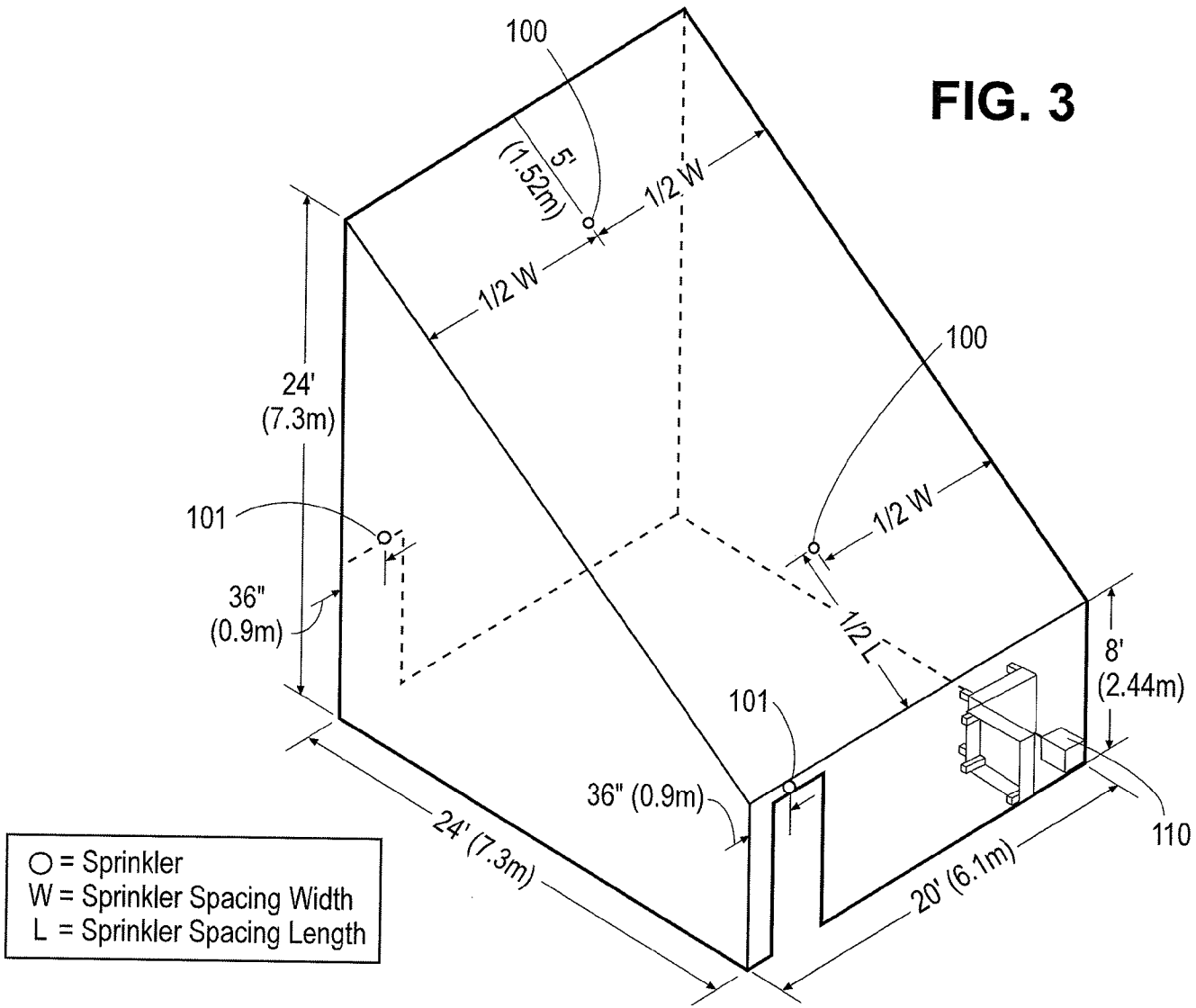
FIG. 3 is a schematic view of the testing room shown in FIG. 1 having a fuel package in the low corner.
Figure 5:
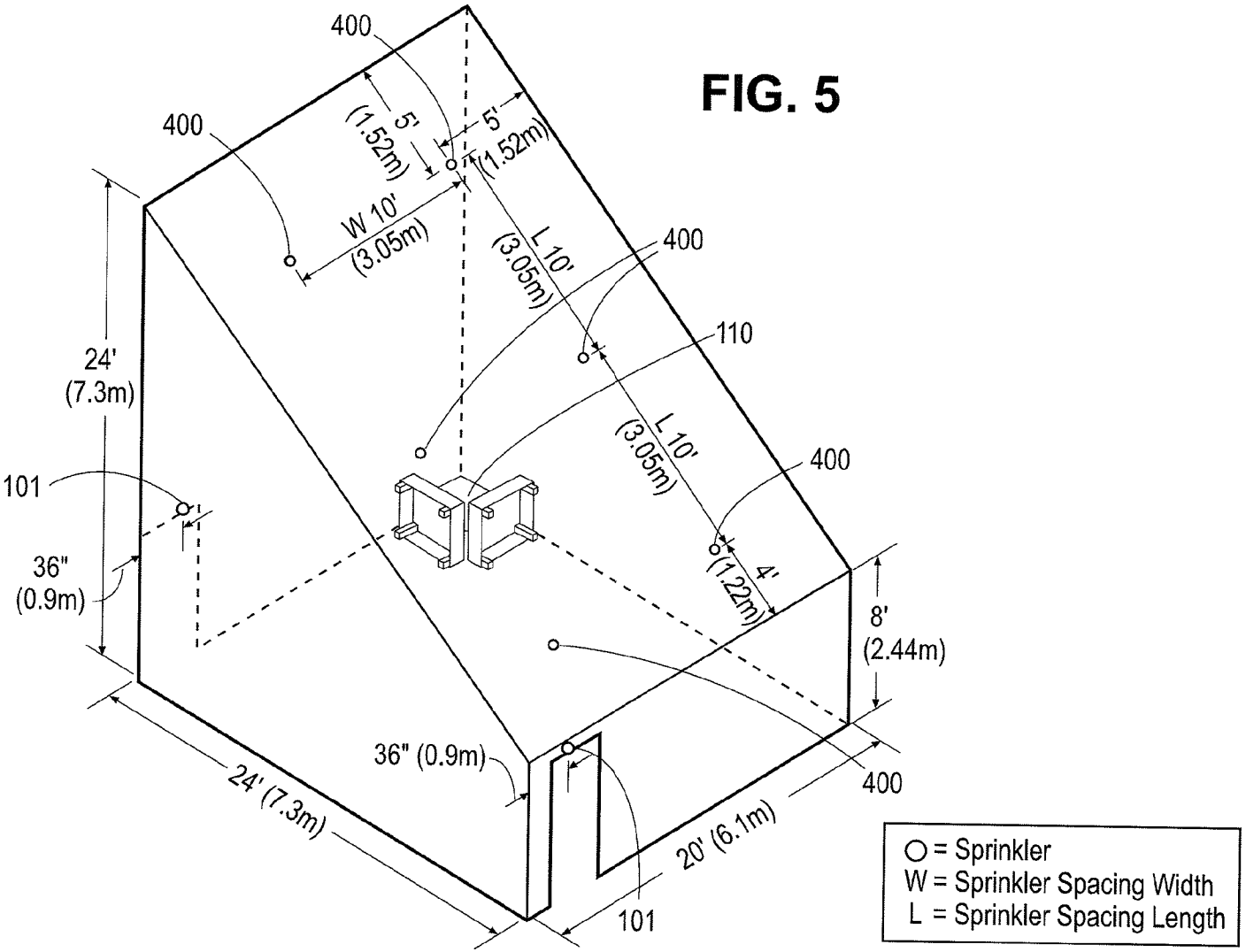
FIG. 5 is a schematic view of the testing room shown in FIG. 4 configured for a fire test with a fuel package in a high corner of the test room.

For both the high corner and low corner test configurations shown in FIGS. 2 and 3, respectively, upon igniting the fuel package 110 temperature measurements are taken during the testing at certain locations in the room as well as measurements of the flow rate of fluid discharging from the sprinklers 100 which have activated, as specified in section 5.1.1. For example, the placement of thermocouples to measure temperatures during the fire testing is shown in FIG. 5.1 of UL1626A (May 2007), and is reproduced in relevant part in FIG. 1. When fire tested as described in UL 1626A (May 2007), sections 5.1.2 to 5.3.5, the residential sprinkler 100 must limit temperatures as specified in Section 5.1.1 (a) to (d) when tested at each rated spacing and high/low corner configurations referenced in the installation instructions for the sprinklers 100. Specifically, the maximum temperature 3 inches below the ceiling at either location of the pair of sprinkler locations as illustrated in FIG. 1 shall not exceed 600 degrees Fahrenheit. The maximum temperature 5¼ feet above the floor (TC-2) shall not exceed 200 degrees Fahrenheit. Moreover, the temperature at 63 inches above the floor (TC-2) shall not exceed 130 degrees Fahrenheit for more than any continuous two minute period. Also, the maximum ceiling material temperature ¼ inch behind the finished ceiling surface (TC-1) shall not exceed 500 degrees Fahrenheit.

According to UL 1626A (May 2007), section 5.1.1, in order to comply with the testing requirements a maximum of two sprinklers 100 are permitted to operate in the test room and no sprinklers 101 in the doorways 105, 106 shall operate (sprinkler activation in the doorways 105, 106 is an indication that there is heat overflow such as might cause sprinklers in the next room to activate). The testing requirements and temperature limits apply to pendent, upright, flush, recessed pendent, concealed pendent, as well as sidewall sprinklers (when tested in an alternate sprinkler and temperature measurement configuration, described below).

Another requirement of UL 1626A (May 2007) is that the fluid flow to the sprinklers 100 is to be the minimum flow rate specified in the installation instructions for the sprinkler coverage area tested. The listed area of coverage is measured along the ceiling. The actual floor coverage area (i.e., a projected area) will be less than the listed area for ceilings having a non-zero pitch. For example, in the case of residential occupancies having ceilings with a non-zero pitch the minimum flow rate required from a sprinkler 100 is 0.05 gallons per minute per square foot of ceiling area. The test room ceiling area shown in FIGS. 1-3 is 29'×20' (580 sq. ft.). Accordingly, the minimum flow requirement for the testing areas shown in FIGS. 1-3 is at least 29 gpm (580 sq. ft×0.05 gpm/sq. ft). Therefore, for two sprinklers that are activated (i.e., sprinklers which are delivering fluid) the total minimum flow rate in accordance with UL 1626A for protecting the 580 sq. ft. room is 58 gpm.

Figure 4:
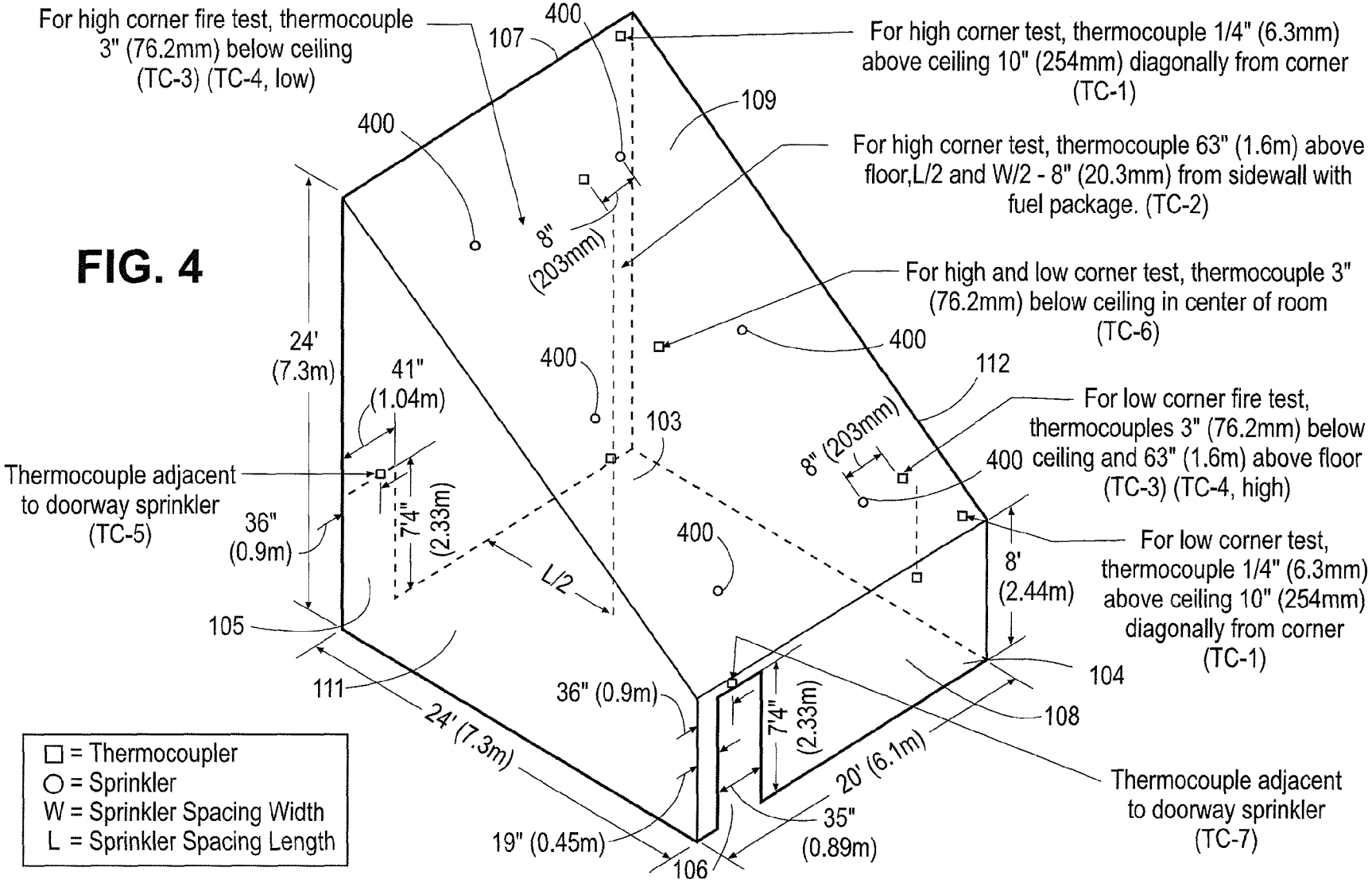
FIG. 4 is a schematic view of an embodiment of a sprinkler system in the testing room shown in FIG. 1, in accordance with an aspect of the invention.

FIG. 4 shows a schematic of the same room shown in FIGS. 1-3, having a modified sprinkler configuration disposed therein in accordance with a first aspect of the invention. Instead of the two sprinklers 100 shown in FIGS. 1-3, FIG. 4 shows a system of six sprinklers 400 spaced apart from each other in a 10'×10' grid below the sloped ceiling 109. The spacing of the sprinklers 400 under the sloped ceiling is measured along the slope when determining the distance off of walls and between sprinklers. The sprinklers 104 are at least one of pendent, upright, flush, recessed pendent, and concealed pendent sprinklers, and preferably are approved for residential use. The sprinklers 400 are connected to a fluid supply (not shown) so as to be in fluid communication with a fluid, such as water. The fluid supply is configured to provide fluid to each of the sprinklers at a minimum operating pressure. For example, in one embodiment, the fluid supply is configured to deliver fluid to the sprinklers 400 at least 5 psi. While the 10'×10' spacing is shown in FIG. 4, it is understood that a spacing of less than 20'×20' and 10'×10', such as at least 8'×8', may also be used.

Figure 6:
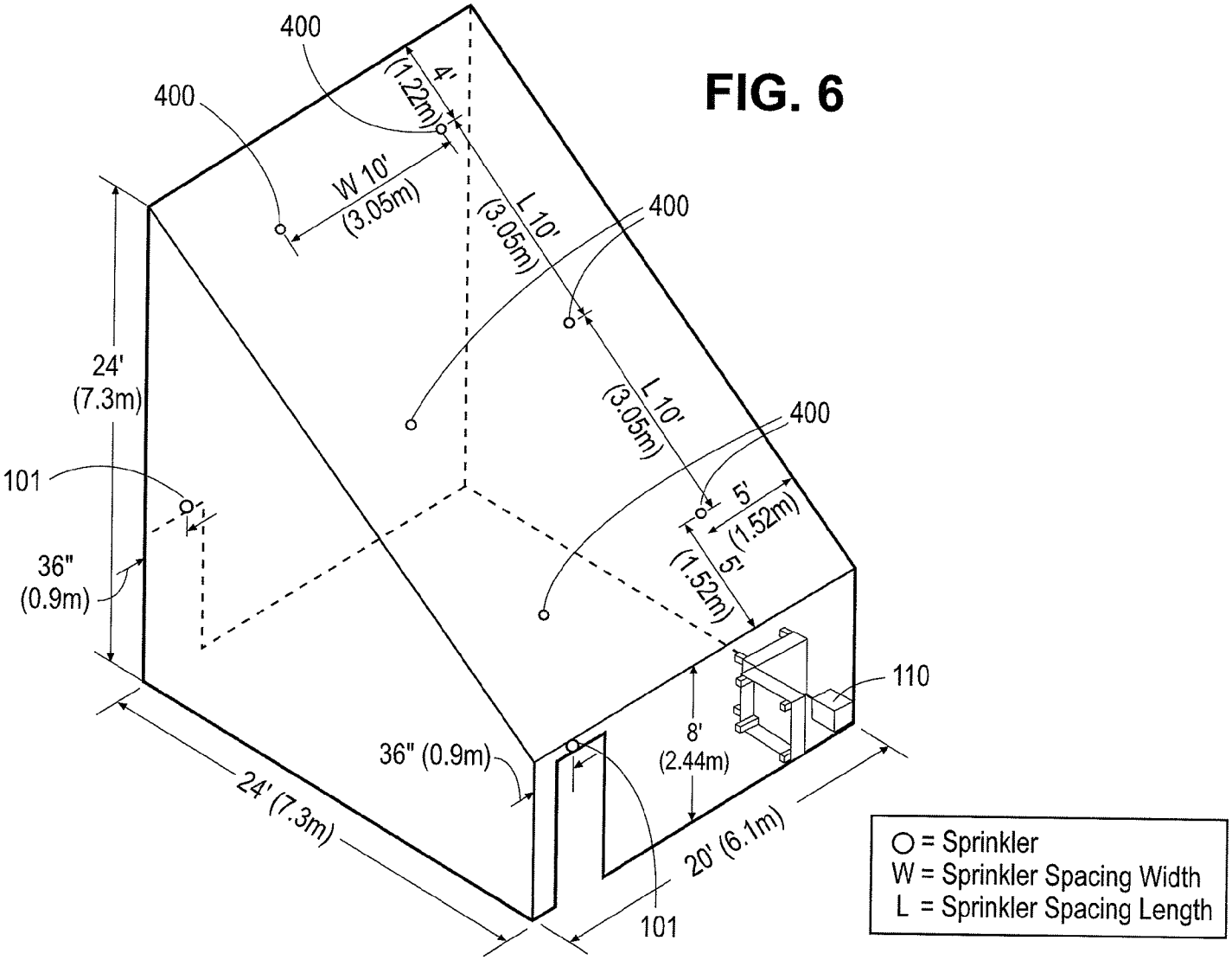
FIG. 6 is a schematic view of the testing room shown in FIG. 4 configured for a fire test with a fuel package in a low corner of the test room.

The sprinkler arrangement shown in FIG. 4 is shown in FIG. 5 configured for a high corner fire test, with the fuel package 110 and wood crib disposed in the high corner 103, in similar fashion to that shown in FIG. 2. FIG. 6 shows a schematic of the room shown in FIG. 5, except that the fuel package 110 and wood crib are disposed in the low corner 104 of the room. As shown in FIG. 6, the sprinkler 400 spacing down the ceiling is modified for the low corner test configuration as compared to the high corner test (FIG. 5). In particular, when configured for the low corner fire test (FIG. 6) the three rows of sprinklers 400 across the ceiling 109 are shifted upward one foot along the ceiling, as compared to the sprinkler spacing along the ceiling 109 shown in FIG. 5 for the high corner fire test.

At least six arrangements of fire protection sprinklers using different sets of six sprinklers 400 have been configured in accordance with the 10'×10' grid arrangement shown in FIGS. 5 and 6. Testing of each of the fire protection sprinkler systems configured in both the high corner and low corner test configurations, as shown in FIGS. 5 and 6 respectively, was conducted in accordance with UL 1626A (May 2007) Sections 5.2 and 5.3, except as those sections are modified in accordance with the various aspects of the invention described herein. The fire tests are conducted for 30 minutes after ignition of the wood crib and fuel package 110 in the respective low corner 104 or high corner 103, unless after 10 minutes, all of the combustibles are extinguished or only the wood crib is sustaining combustion, at which point the test is to be terminated. The water flow to the sprinklers 400 is to be the minimum flow rate specified in the installation instructions for the sprinkler coverage area tested, which in the embodiment shown in FIGS. 4-6 is a residential occupancy having a coverage area defined by the testing room ceiling. As discussed above, the minimum flow rate specified for sprinkler coverage area for residential occupancy is 0.05 gpm/sq. ft. The individual test result data sheets are shown in FIGS. 7-20. The test results are summarized in Table 1, below.

TABLE 1

Test Results for Sloped Ceilings 8/12 pitch, 10 ft × 10 ft coverage area, 10 ft × 10 ft sprinkler spacing, 580 sq. ft. listed coverage area

| Example | Sprinkler Type | K-factor | No. of Sprinklers Tested | No. of Sprinklers Activated | Flow per sprinkler/inlet pressure (gpm/psi) | Sprinkler Temperature Rating, (F. °) |
|---|---|---|---|---|---|---|
| 1 | Pendent Residential | 3 | 6 | 3 | 8-13/7-19 | 155 |
| 2 | Pendent Residential | 4.9 | 6 | 3 | 13/7.0 | 155 |
| 3 | Pendent Residential Recessed (0.5 inch recess) | 4.9 | 6 | 2 | 13/7.0 | 155 |
| 4 | Pendent Residential Conical Concealed CCP | 4.9 | 6 | 2 | 13/8.2 | 155 |
| 5 | Pendent Residential Flat concealed RFC | 4.9 | 6 | 2 | 14/8.2 | 165 |
| 6 | Pendent Residential Flat concealed RFC | 4.3 | 6 | 2 | 18/15.6 | 165 |

Example 1

A first set of six pendent residential sprinklers 400 (model F1 Res 30, manufactured by The Reliable Automatic Sprinkler Co., Inc.) having a K-factor of 3.0 were tested in the configurations shown in FIGS. 5 and 6. Using the first set of sprinklers 400, during the high corner (FIG. 5) and low corner (FIG. 6) tests, an average of only three sprinklers 400 were observed to activate (i.e., open to release fluid from the fluid supply) resulting in a per sprinkler 400 flow rate of between 8 and 13 gpm. Accordingly the total flow rate of the three sprinklers that activated was 39 gpm, which is 19 gpm less than the 58 gpm (2-29 gpm sprinklers for a 580 sq. ft. ceiling) required by the existing UL listing criteria.

Example 2

A second set of six residential sprinklers 400, (model F1 Res 49, manufactured by The Reliable Automatic Sprinkler Co., Inc.) having a K-factor of 4.9, were connected to the fluid supply and arranged as shown in FIGS. 5 and 6. Using the second set of six sprinklers 400, during the high corner (FIG. 5) and low corner (FIG. 6) tests, an average of only three sprinklers 400 were observed to activate (i.e., open to release fluid from the conduit) resulting in a per sprinkler 400 flow rate of 13 gpm. Thus, even when three sprinklers 400 flow with a rate of 13 gpm, the total flow demand of the three sprinklers 400 is only 39 gpm, which is 19 gpm less than the 58 gpm (2-29 gpm sprinklers for a 580 sq. ft. ceiling) required by the existing UL listing criteria. As a result, it has been observed that the fire protection configuration shown in FIGS. 5 and 6 can meet the requirements of UL 1626A (May 2007) and NFPA 13 while at the same time reducing the fluid demand per sprinkler 400 below the minimums set by those respective standards.

Example 3

A third set of six recessed pendent residential fire protection sprinklers 400 (model F1 Res 49 recessed, manufactured by The Reliable Automatic Sprinkler Co., Inc.) having a K-factor of 4.9 were connected to the fluid supply and arranged as shown in FIGS. 5 and 6. During testing of the third set of sprinklers 400 in the configurations shown in FIGS. 5 and 6, an average of two sprinklers 400 activated resulting in a per sprinkler 400 flow rate of about 13 gpm at a minimum sprinkler inlet pressure of 7.0 psi. Testing results in the high corner configuration (FIG. 5) are summarized in FIGS. 7 and 8. "Thermocouple ID #" noted in FIGS. 7 and 8 refer to the thermocouples positioned in the testing room as shown in FIG. 4. FIG. 7 shows test results for the sprinkler 400 configuration where the frame arms are perpendicular to the high wall 107 and FIG. 8 shows the results for the sprinkler configuration where the frame arms are parallel to the high wall 107. A low corner configuration (FIG. 6) using recessed pendent residential fire protection sprinklers was not conducted as it is believed that the high corner fire test is more challenging than the low corner fire test. Accordingly, it is expected that the third set of sprinklers 400 would perform as at least as well in addressing a fire in the low corner fire test configuration as in the high corner fire test configuration.

Example 4

Instead of performing a low corner fire test using the third set of sprinklers, low corner fire testing (FIG. 6) was conducted using a configuration of conical concealed pendent (CCP) residential fire protection sprinklers which are considered a more challenging configuration for fire protection because of the increase in delay in activation of the sprinkler due in part to the inclusion of the conical cover and blockage of ventilation openings. In accordance with UL 1626a (May 2007), section 5.2.4.5, the recessed and concealed sprinklers tested in Examples 1-6 were installed and tested in a manner that inhibits airflow through vented escutcheons (i.e., in a blocked configuration) by placing a 36 inch×15½ inch×8 inch (910 mm×390 mm×200 mm) R-25 fiberglass insulating batt over the sprinkler.

Accordingly, a fourth set of six recessed conical concealed pendent residential sprinklers 400 (model F1 Res 49 CCP, manufactured by The Reliable Automatic Sprinkler Co., Inc.) having a K-factor of 4.9 were connected to the fluid supply and arranged as shown in FIGS. 5 and 6. During testing of the fourth set of sprinklers in the configurations shown in FIGS. 5 and 6, an average of two sprinklers activated resulting in a flow rate of 13 gpm per sprinkler at a minimum sprinkler inlet operating pressure of 8.2 psi. A summary of the test conditions and results for the high corner sprinkler test configuration (FIG. 5) are shown in FIGS. 9 and 10 (sprinkler 400 frame arms perpendicular and parallel to the high wall 107, respectively), and a summary of the test conditions and results for the low corner sprinkler test configuration (FIG. 6) are shown in FIGS. 11 and 12 (sprinkler 400 frame arms parallel and perpendicular to the low wall 108, respectively).

Example 5

A fifth set of six flat concealed pendent residential sprinklers 400 (model RFC 49, manufactured by The Reliable Automatic Sprinkler Co., Inc.) having a K-factor of 4.9 were connected to the fluid supply and arranged as shown in FIGS. 5 and 6. During testing of the fifth set of sprinklers 400 in the configurations shown in FIGS. 5 and 6, an average of two sprinklers activated resulting in a flow rate of 14 gpm per sprinkler at a minimum sprinkler inlet operating pressure of 8.2 psi. A summary of the test conditions and results for the low corner sprinkler test configuration (FIG. 6) are shown in FIGS. 13 and 14 (sprinkler 400 frame arms perpendicular and parallel to the low wall 108, respectively), and a summary of the test conditions and results for the high corner sprinkler test configuration (FIG. 5) are shown in FIGS. 15 and 16 (sprinkler 400 frame arms perpendicular and parallel to the high wall 107, respectively).

Example 6

A sixth set of six flat concealed pendent residential sprinklers 400 (model RFC 43, manufactured by The Reliable Automatic Sprinkler Co., Inc.) having a K-factor of 4.3 were connected to the fluid supply and arranged as shown in FIGS. 5 and 6. During testing of the sixth set of sprinklers 400 in the configurations shown in FIGS. 5 and 6, an average of two sprinklers 400 activated resulting in flow rates of 18 gpm per sprinkler at a minimum sprinkler inlet operating pressure of 15.6 psi. A summary of the test conditions and results for the low corner sprinkler test configuration (FIG. 6) are shown in FIGS. 17 and 18 (sprinkler frame arms perpendicular and parallel to the low wall 108, respectively), and a summary of the test conditions and results for the high corner sprinkler test configuration are shown in FIGS. 19 and 20 (sprinkler 400 frame arms perpendicular and parallel to the high wall 107, respectively).

While the foregoing exemplary embodiments have employed fire protection sprinklers 400 having K-factors of 3.0, 4.3, and 4.9, it is to be understood that sprinklers having other K-factors may be used, including K-factors of at least 2.8, such as, but not limited to, 3.9, 4.2, 4.3, 5.6, 5.8, 6.9, 7.4, 7.6 and 14. Also, while discrete K-factors are listed, sprinklers having a listed K-factor within a range of K-factors may be used. Moreover, while the configurations of sprinklers 400 have been described as specifying a certain number of sprinklers used (e.g., a set of 6), it is to be understood that it is within the scope of the invention to use various numbers of sprinklers, including at least two.

UL 1626A (May 2007) also covers fire testing of residential horizontal sidewall sprinklers for use with smooth, flat, sloped ceilings. The UL 1626A (May 2007) standard covers configurations of horizontal sidewall sprinklers discharging across the ceiling (e.g., UL 1626A, FIGS. 5.4-5.6) and discharging down the slope of the ceiling (e.g., UL 1626A, FIGS. 5.7-5.12). According to UL 1626A (May 2007) Section 1.4, for sidewall sprinklers discharging across the slope, sprinklers are installed through one sidewall of the room and are positioned 4 to 6 inches below the sloped ceiling. Sprinklers discharging down the sloped ceiling are installed through the top of the high wall and are positioned 4 to 12 inches below the sloped ceiling. In either configuration of discharge (across or down the sloped ceiling) the deflector of the sidewall sprinkler is positioned to be parallel to the ceiling (e.g., FIG. 26). The temperature requirements described above with respect to pendent, upright, flush, recessed pendent, and concealed pendent sprinklers, also apply to the testing of sidewall sprinklers, except that the locations of the temperature measurements are different from those shown in FIGS. 1 and 4 and are based on whether the sidewall sprinklers discharge across or down the slope of the ceiling.

Figure 21:
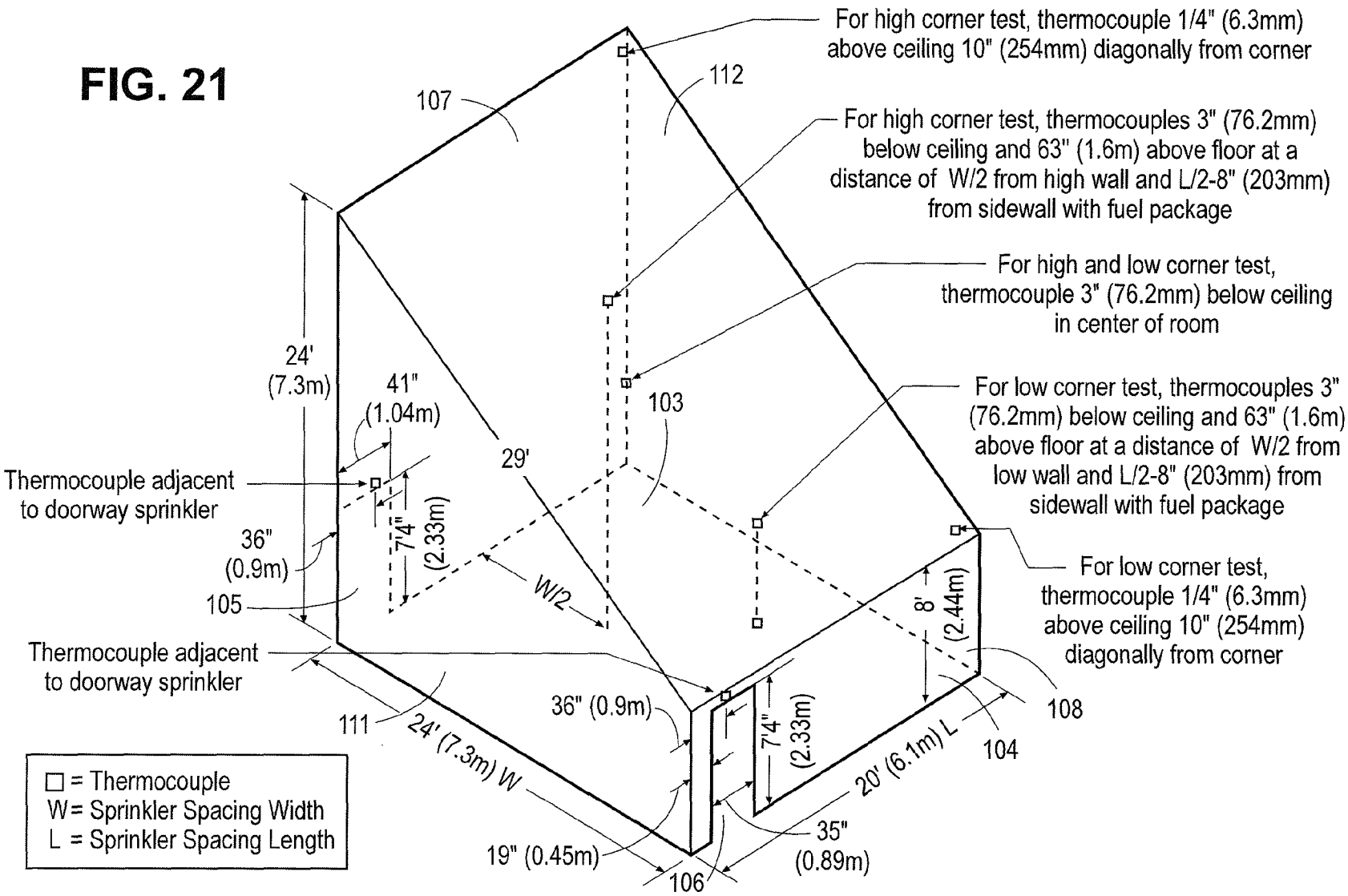
FIG. 21 is a schematic view of a sprinkler arrangement and thermocouple placement for a sloped ceiling residential fire test for 8/12 pitch sidewall sprinklers discharging across the slope in accordance with UL Standard 1626a (May 2007).
Figure 22:
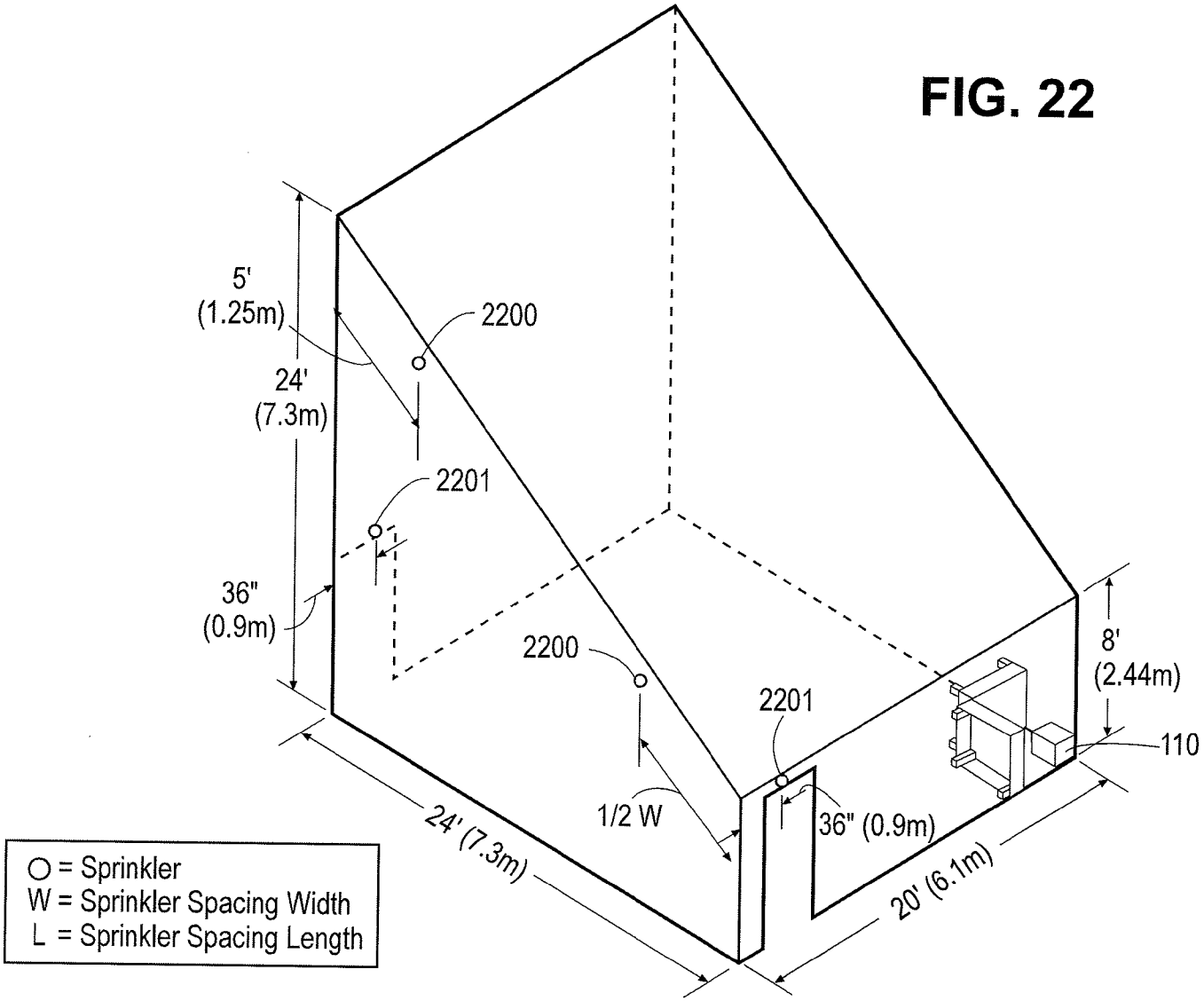
FIG. 22 is a schematic view of the testing room of FIG. 21 configured for a low corner fire test in accordance with UL Standard 1626a (May 2007).

Temperature measurement locations in a test room configured in accordance with UL 1626A (May 2007) for testing horizontal sidewall sprinklers discharging across the ceiling are shown in FIG. 21. The test room shown in FIG. 21 has the same dimensions as the test rooms shown in FIGS. 1 and 4. The temperature measurement locations shown in FIG. 21 include measurement locations for both high corner and low corner fire tests. According to UL 1626A (May 2007), a maximum of two horizontal sidewall sprinklers are permitted to be installed within 3 ft. vertically of the peak to protect the test area, which is shown in FIG. 22 configured for a low corner test and in FIG. 23 for a high corner test.

In accordance with a second aspect of the invention a sprinkler system is provided for protecting a residential occupancy having a sloped ceiling with pitch up to 12/12. The system includes a plurality of horizontal sidewall sprinklers configured to direct fluid across the underside of a sloped ceiling at least a minimum pressure. The sprinklers are spaced at least 8 feet apart from one another.

Figure 24:
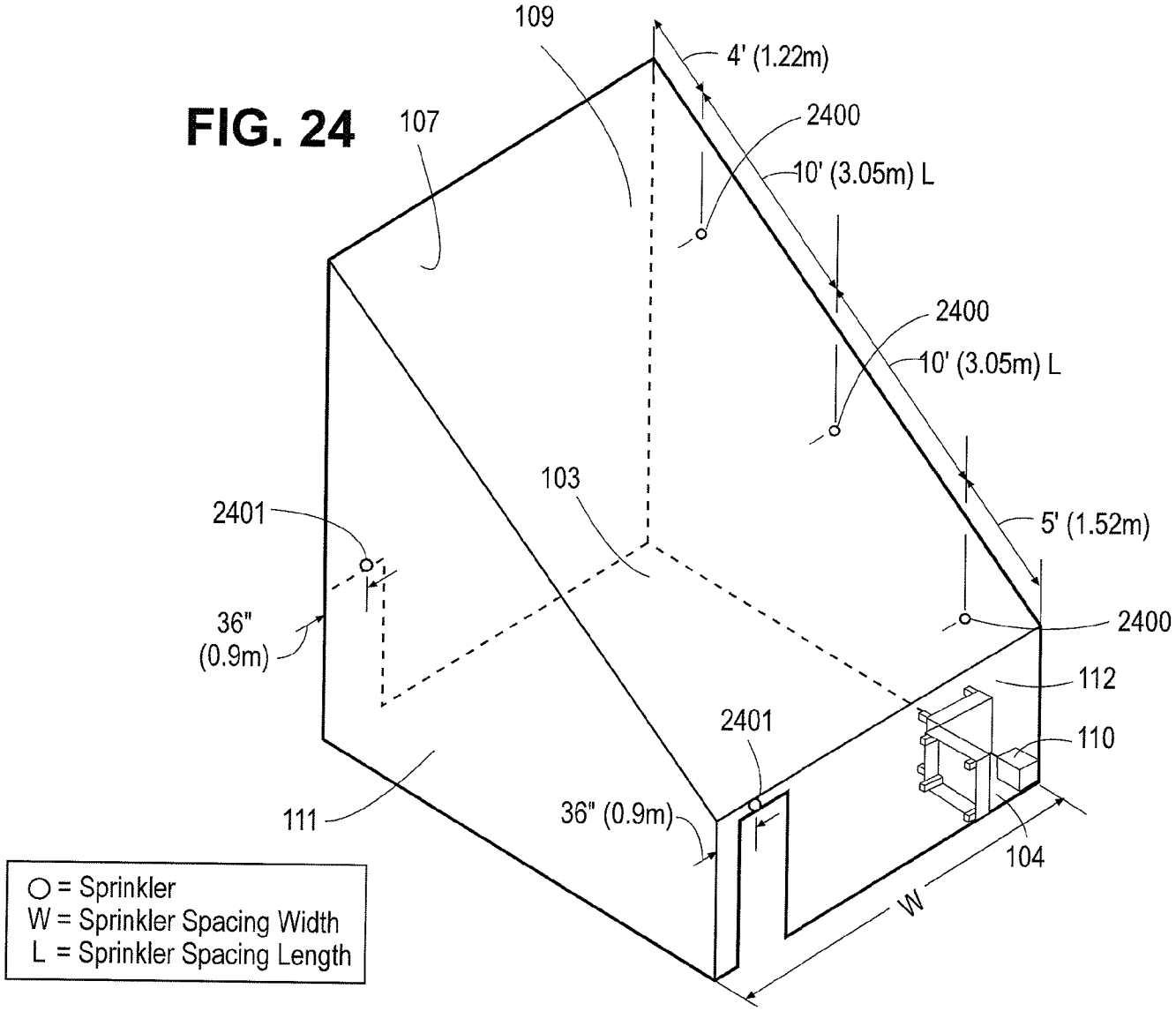
FIG. 24 is a schematic view of an embodiment of a sprinkler system in the testing room shown in FIG. 21, in accordance with another aspect of the invention, the fire testing room being configured for a low corner fire test.

FIG. 24 shows an embodiment of the horizontal sidewall sprinkler system in accordance with the second aspect using 3 horizontal sidewall sprinklers 2400 in a low corner fire test sprinkler configuration (i.e., with the fuel package 110 and wood crib in the low corner 104). The three sprinklers 2400 are installed in-line with one another towards the upper portion of one of sidewall 112 with their deflectors below and parallel to the ceiling (FIG. 26) and are configured to direct fluid across the ceiling 109. The deflectors are spaced below the ceiling in accordance with UL 1626A (2007). In this low corner test configuration, the three sprinklers 2400 are spaced 10 feet apart in-line below and parallel to the ceiling 109 with the vertically lowermost sprinkler 2400 being disposed about 5 feet upward along the ceiling from the low wall 108 and the uppermost sprinkler 2400 being disposed about 4 feet down the ceiling from the top of the upper wall 107. A third or intermediate sprinkler 2400 is located a length L equal to the sprinkler spacing length from both the uppermost and lowermost sprinklers. In the embodiment shown in FIG. 24, the sprinkler spacing length is 10 feet and is also equal to the sprinkler spacing width W.

Figure 25:
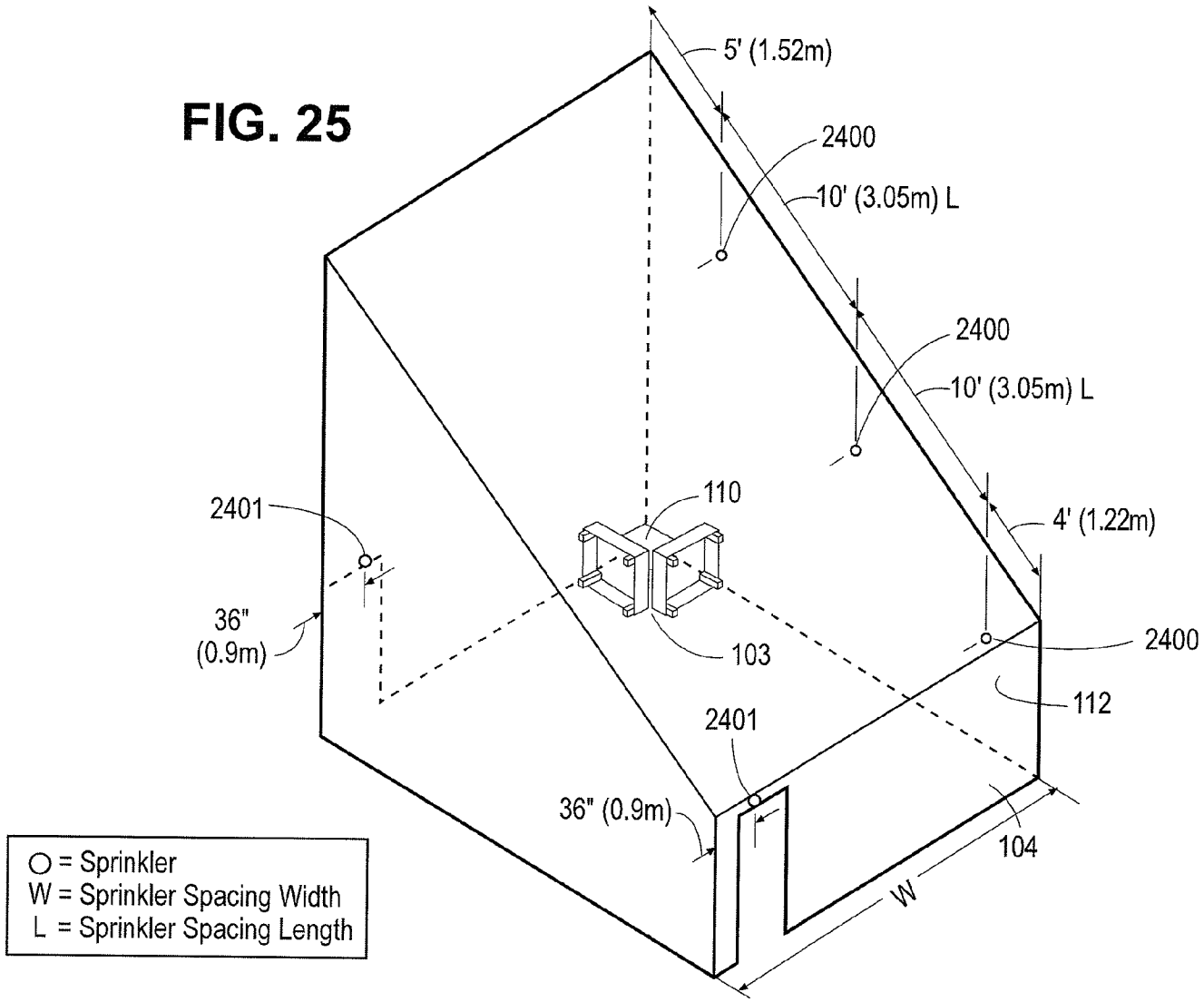
FIG. 25 is a schematic view of the sprinkler system shown in FIG. 24 configured for a high corner fire test.

FIG. 25 shows a modified, high corner, fire test arrangement of the sprinklers 2400 compared to the sprinkler arrangement shown in FIG. 24. The column of sprinklers 2400 extending from the sidewall 112 in FIG. 25 is shifted one foot downward, parallel to the sloped ceiling 109, toward the low wall 108 as compared to the positions shown in FIG. 24.

Figure 26:
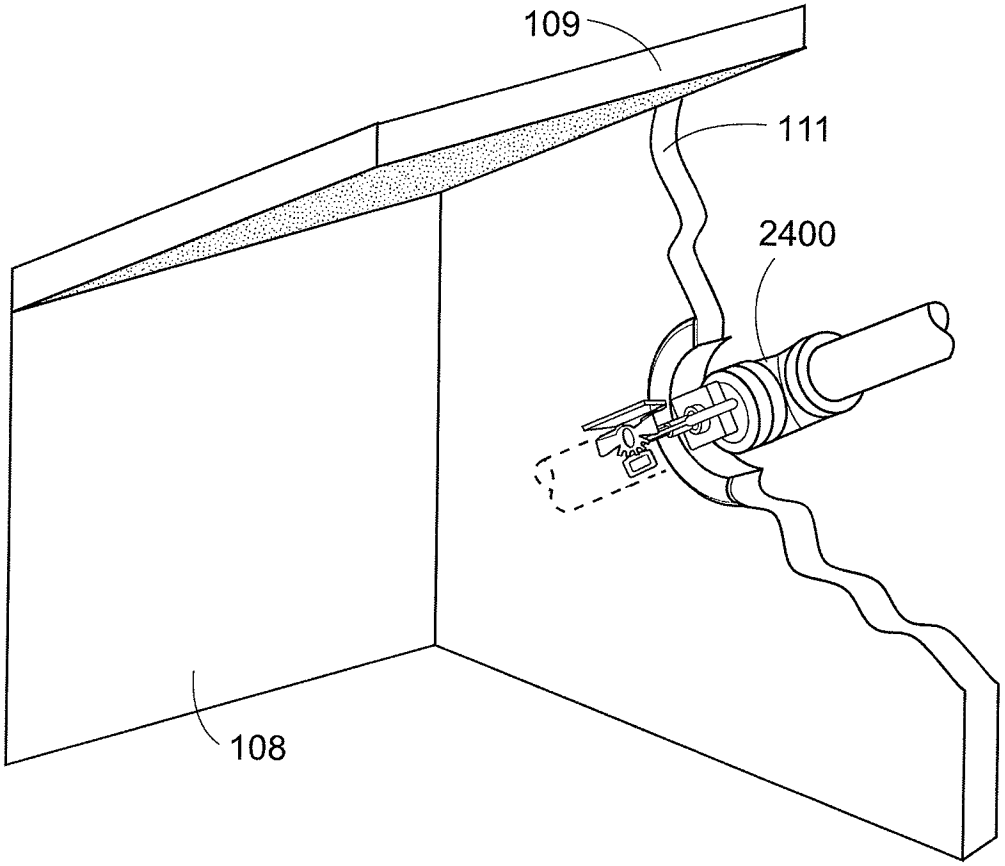
FIG. 26 is an enlarged view of the horizontal sprinkler placement in the testing room shown in FIGS. 21-25.

In accordance with NFPA 1626A (May 2007), Section 5.3.5, the sprinklers 2400 are installed with their deflectors located at least 4 inches below the ceiling 109 and with the deflectors at the maximum distance below the ceiling as specified in the installation instructions for the respective sprinkler if the maximum distance exceeds 6 inches. FIG. 26 shows a partial cutaway view of the sidewall 112 and the ceiling 109 showing the orientation of a deflector of a representative horizontal sidewall sprinkler 2400 showing the deflector as being substantially parallel to the ceiling 109.

Figure 23:
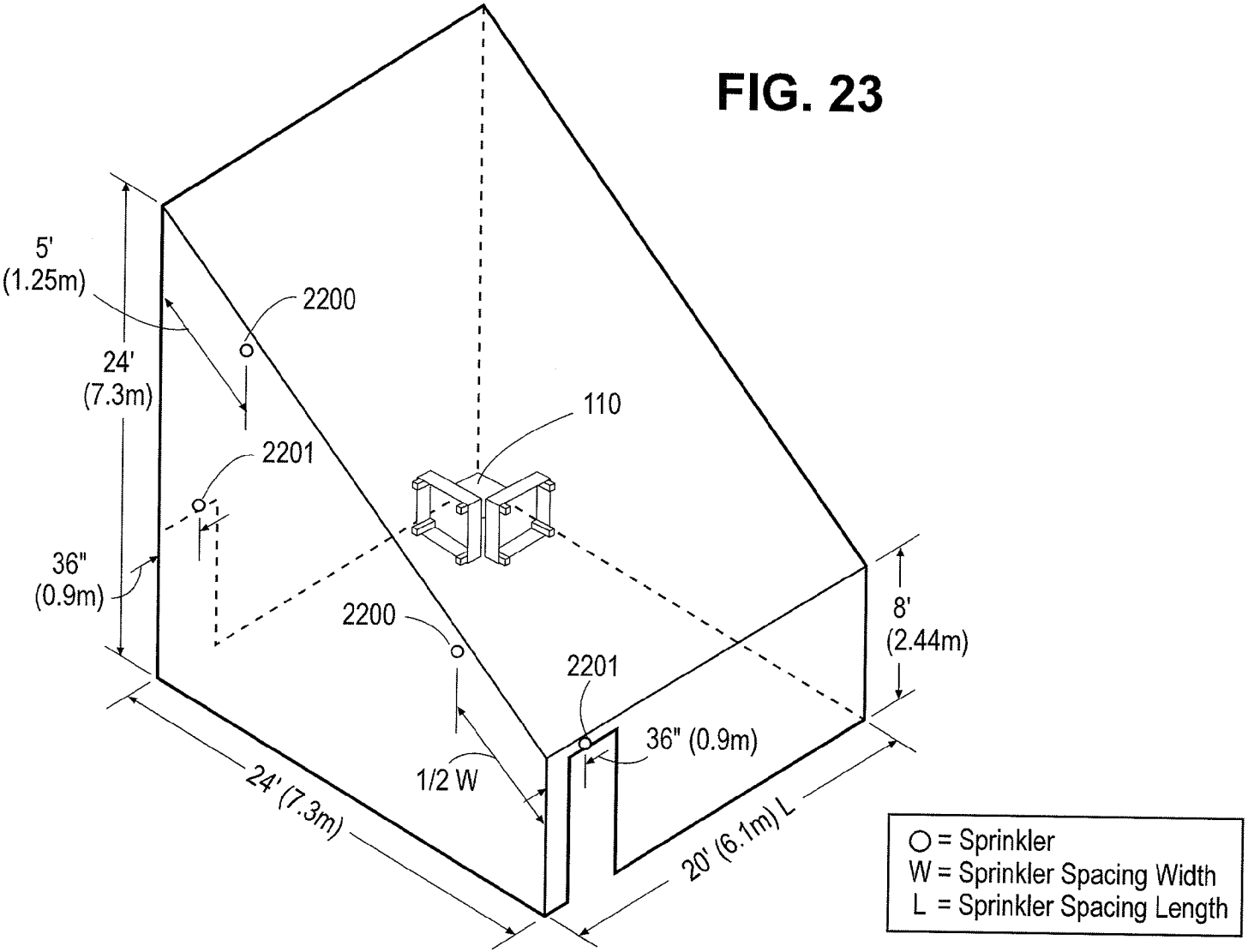
FIG. 23 is a schematic view of the testing room of FIG. 20 configured for a high corner fire test in accordance with UL Standard 1626a (May 2007).

In one embodiment, Model F1 Res 44 horizontal sidewall sprinklers, manufactured by The Reliable Automatic Sprinkler Co., Inc. are used as the horizontal sidewall sprinklers 2400 in the arrangements shown in FIGS. 23 and 24. Such Model F1 Res 44 sprinklers 2400 have a nominal K-factor of 4.4, such that at an inlet operating pressure of 13.2 psi (0.92 bar) the sprinkler discharges at a rate of 16 gpm (60.5 lpm) and such that at an inlet pressure of 7 psi the sprinkler discharges at a rate of 12 gpm. In an alternate embodiment, Model F1 Res 58 horizontal sidewall sprinklers, manufactured by The Reliable Automatic Sprinkler Co., Inc., are used in the arrangement shown in FIGS. 23 and 24. Such Model F1 Res 58 sprinklers have a nominal K-factor 5.8, such that at an inlet pressure of 13.2 psi (0.92 bar) each activated sprinkler discharges at a rate of 21 gpm (80 lpm) and at an inlet pressure of 7 psi each activated sprinkler discharges at a rate of 15 gpm. Using the F1 Res 44 horizontal sprinklers, if all three sprinklers activated the total flow rate would be 48 gpm, which is lower than the 58 gpm minimum required by UL 1626A for the 580 sq. ft. coverage area of the test configuration shown in FIGS. 23-25. Moreover, it is expected that where the inlet pressure to the F1 Res 44 sprinklers is lowered to 7 psi, and all of the sprinklers activated to discharge fluid at 12 gpm per sprinkler, the total flow would be effective at addressing the fire while reducing the total flow to 36 gpm, which is lower than the requirement for a residential occupancy having the dimensions of the test room shown in FIGS. 23-25. Likewise, at the 10 foot sprinkler spacing shown in FIGS. 24 and 25, using the F1 Res 58 horizontal sprinklers, if an average of only two sprinklers activate during fire testing in the high and low corner test conditions (FIGS. 25 and 24, respectively) the total flow rate is 42 gpm, which is lower than the 58 gpm required by UL 1626A for the 580 sq. ft. coverage area. Moreover, it is expected that where the inlet pressure to the Model F1 Res 58 sprinklers is lowered to 7 psi, and all three of the sprinklers activated to discharge fluid at 15 gpm per sprinkler, the total flow of 45 gpm would be effective at addressing the fire while reducing the total flow below the 58 gpm required for a residential occupancy having the dimensions of the test room shown in FIGS. 23-25. Accordingly, in at least one embodiment the fire protection configuration shown in FIGS. 23 and 24 can meet the requirements of UL 1626A and NFPA 13 while at the same time reducing the fluid demand per sprinkler below the minimum set by those standards.

While the foregoing discussion has mentioned sidewall sprinkler arrangements (FIGS. 23-26) of sprinklers 2400 discharging across the slope of the ceiling 109, in another embodiment the sprinklers 2400 are arranged with sprinkler spacing down to 8 feet and positioned to discharge down the sloped ceiling, in similar fashion to the testing configurations shown in UL 1626A, (May 2007) FIGS. 5.7-5.12. In at least one embodiment, the system may be configured to protect an occupancy below a sloped ceiling including sidewall residential sprinklers discharging down the slope, wherein the sprinklers are connected to a fluid supply and are configured to be spaced 10 feet apart at through the top of the high wall 107 of the room shown in FIG. 5.7 of UL 1626A, (May 2007), such that the delivered flow rate per activated sprinkler is less than or equal to 0.05 gallons per minute per square foot.

Advantages of the lower operating pressures and/or flow rates of the sprinklers in the foregoing embodiments of sloped ceiling fire protection systems in comparison to sprinkler flow rates of sprinklers configured to operate in conventional sloped ceiling fire protection systems designed in accordance with NFPA 1626A (May 2007) are that piping and flow meter sizes of the fire protection system in fluid communication with the sprinklers can be reduced, which equates into cost reduction compared to larger components. Additionally, by virtue of the lower fluid demand requirements and system component size reductions, the sprinklers can operate at lower operating pressures, reducing the need to install booster pumps to increase the pressure. Eliminating such a booster pump from the fire can simplify the design and reduce the cost of the sprinkler system.

What is claimed is:

1. A method of protecting a residential occupancy below a smooth flat sloped ceiling having a pitch of up to 12/12, the method comprising the steps of:

providing at least two residential fire protection sprinklers below the smooth flat sloped ceiling of the residential occupancy having a pitch of up to 12/12, the sprinklers having a nominal K-factor of at least 2.8 gpm/(psi)$^{1/2}$, whereas the residential occupancy and the smooth flat sloped ceiling of the residential occupancy are defined as per Underwriters' Laboratories, Inc. (UL), Fire Protection Equipment Directory, 2006 and National Fire Protection Association (NFPA), Automatic Sprinkler Systems Handbook, 2002 edition;

disposing the residential fire protection sprinklers at respective predetermined distances below the smooth flat sloped ceiling and spacing the sprinklers at least 8 feet apart from one another; and fluidly coupling the residential fire protection sprinklers to a fluid supply configured to supply the sprinklers with fluid at at least a predetermined source pressure, such that upon activation of one or more of the sprinklers, the fluid delivered per activated sprinkler is less than 0.05 gallons per minute per square foot.

2. The method according to claim 1, wherein the sprinklers are spaced apart from one another in a grid at spacings of 10 feet by 10 feet.

3. The method of using a residential fire protection sprinkler according to claim 2, wherein the sprinklers have a K-factor of at least 3.0 gpm/(psi)$^{1/2}$.

4. The method according to claim 3, wherein the fluid supply conduit is configured to deliver fluid to the sprinkler at at least 5 pounds per square inch.

5. The method according to claim 2, wherein the sprinklers have a K-factor of at least 4.9 gpm/(psi)$^{1/2}$.

6. The method according to claim 5, wherein the fluid supply conduit is configured to deliver fluid to the sprinkler at at least 5 pounds per square inch.

7. The method according to claim 2, wherein the sprinklers have a K-factor between 2.8 and 7.6 gpm/(psi)$^{1/2}$.

8. The method according to claim 7, wherein the fluid supply conduit is configured to deliver fluid to the sprinkler at at least 5 pounds per square inch.

9. The method according to claim 1, wherein the sprinklers include at least one of a pendent, recessed, concealed recessed, concealed, flat concealed, and horizontal sidewall type.

10. The method of using a residential fire protection sprinkler according to claim 1, wherein up to six sprinklers are otherwise connected to the conduit in accordance with UL 1626A (May 22, 2007), section 5.2.4 and the occupancy is configured in accordance with UL 1626A (May 22, 2007), section 5.2.2.

11. The method according to claim 1, wherein the occupancy is configured as a room defined by a floor having a length of 24 feet long and a width of 20 feet, a 24 foot×20 foot high wall spaced 24 feet from an opposing 8 foot×20 foot low wall, the high and low walls connected at their tops by a smooth flat sloped ceiling and at their vertical sides by two opposing sidewalls spaced 20 feet apart, and wherein the room is configured in accordance with a sloped ceiling residential fire test in accordance with the May 22, 2007 edition of UL Standard 1626A.

12. A residential fire protection sprinkler system for a residential occupancy below a smooth flat sloped ceiling having a pitch up to 12/12, the system comprising:

at least two residential fire protection sprinklers disposed below the smooth flat sloped ceiling of the residential occupancy at a predetermined distance from the ceiling, the ceiling having a pitch of up to 12/12, and the sprinklers having a K-factor of at least 2.8 gpm/(psi)$^{1/2}$, whereas the residential occupancy and the smooth flat sloped ceiling of the residential occupancy are defined as per Underwriters' Laboratories, Inc. (UL), Fire Protection Equipment Directory, 2006 and National Fire Protection Association (NFPA), Automatic Sprinkler Systems Handbook, 2002 edition;

a fluid supply in fluid communication with said residential fire protection sprinklers, the fluid supply configured to supply fluid to said residential fire protection sprinklers at a predetermined source pressure, wherein the at least two residential fire protection sprinklers are spaced at least eight feet apart from one another, such that upon activation of one or more of the sprinklers the fluid delivered per activated sprinkler is less than 0.05 gallons per minute per square foot.

13. The system according to claim 12, wherein the sprinklers are spaced apart from one another in a grid at spacings of 10 feet by 10 feet.

14. The system according to claim 13, wherein the sprinklers have a K-factor of at least 3 gpm/(psi)$^{1/2}$.

15. The system according to claim 14, wherein the fluid supply conduit is configured to deliver the fluid to the fire protection sprinklers at at least 5 pounds per square inch.

16. The sprinkler system according to claim 13, wherein the sprinklers have a K-factor of at least 4.3 gpm/(psi)$^{1/2}$.

17. The system according to claim 16, wherein the fluid supply conduit is configured to deliver the fluid to the fire protection sprinklers at at least 5 pounds per square inch.

18. The system according to claim 13, wherein the sprinklers have a K-factor of at least 4.9 gpm/(psi)$^{1/2}$.

19. The system according to claim 18, wherein the fluid supply conduit is configured to deliver the fluid to the fire protection sprinklers at at least 5 pounds per square inch.

20. The system according to claim 13, wherein the sprinklers have a K-factor between 2.8 and 7.6 gpm/(psi)$^{1/2}$.

21. The system according to claim 20, wherein the fluid supply conduit is configured to deliver the fluid to the fire protection sprinklers at at least 5 pounds per square inch.

22. The system according to claim 12, wherein the system includes up to six sprinklers connected to the fluid supply, wherein the occupancy is configured as a room defined by a floor having a length of 24 feet long and a width of 20 feet, a 24 foot×20 foot high wall spaced 24 feet from an opposing 8 foot×20 foot low wall, the high and low walls connected at their tops by a smooth flat sloped ceiling and at their vertical sides by two opposing sidewalls spaced 20 feet apart, and wherein the room is configured in accordance with a sloped ceiling residential fire test in accordance with the May 22, 2007 edition of UL Standard 1626A, section 5.2.2 (May 22, 2007).

23. The system according to claim 22, wherein the type of sprinklers connected include at least one of a pendent, recessed, upright, concealed recessed, concealed, flat concealed, and horizontal sidewall sprinklers.

24. The system according to claim 23, wherein the system includes 6 pendent sprinklers arranged in a grid with a spacing of 10 feet, wherein deflectors of the sprinklers are disposed at least 3 inches below and parallel to the ceiling.

25. The system according to claim 23, wherein the system includes 3 horizontal sidewall sprinklers configured to discharge across the ceiling through a sidewall of the occupancy below the ceiling, the sprinklers spaced 10 feet apart from one another, wherein deflectors of the sprinklers are disposed at least 4 inches below and parallel to the ceiling.

26. The system according to claim 23, wherein the system includes 3 horizontal sidewall sprinklers configured to discharge down the ceiling through the high wall of the occupancy below the ceiling, the sprinklers spaced 10 feet apart from one another, wherein deflectors of the sprinklers are disposed at least 4 inches below and parallel to the ceiling.

* * * * *